US012419444B2

(12) United States Patent
Fuehrer et al.

(10) Patent No.: US 12,419,444 B2
(45) Date of Patent: Sep. 23, 2025

(54) DISPLAY SYSTEM FOR PIVOTABLE SAMPLES AND METHOD

(71) Applicants: Jeffrey R. Fuehrer, Danville, IN (US); Reece Fuehrer, Danville, IN (US); Jeff Reynolds, Danville, IN (US)

(72) Inventors: Jeffrey R. Fuehrer, Danville, IN (US); Reece Fuehrer, Danville, IN (US); Jeff Reynolds, Danville, IN (US)

(73) Assignee: R & R Products, Inc., Danville, IN (US)

( * ) Notice: Subject to any disclaimer, the term of this patent is extended or adjusted under 35 U.S.C. 154(b) by 149 days.

(21) Appl. No.: 18/417,620

(22) Filed: Jan. 19, 2024

(65) Prior Publication Data

US 2025/0000281 A1 Jan. 2, 2025

Related U.S. Application Data

(63) Continuation-in-part of application No. 17/835,333, filed on Jun. 8, 2022, now Pat. No. 12,112,659.

(60) Provisional application No. 63/321,789, filed on Mar. 21, 2022, provisional application No. 63/236,793, filed on Aug. 25, 2021, provisional application No. 63/208,802, filed on Jun. 9, 2021.

(51) Int. Cl.
*A47F 7/16* (2006.01)

(52) U.S. Cl.
CPC ..... *A47F 7/163* (2013.01)

(58) Field of Classification Search
CPC .. G09F 5/00; A47F 5/0087; A47F 5/00; A47F 7/163
See application file for complete search history.

(56) References Cited

U.S. PATENT DOCUMENTS

| | | | | | |
|---|---|---|---|---|---|
| 452,957 | A * | 5/1891 | Staunton | G09F 11/02 | 40/497 |
| 928,292 | A * | 7/1909 | Walsh | A47G 25/0685 | 211/96 |
| 1,049,886 | A * | 1/1913 | Manson | G09F 11/02 | 40/497 |
| 1,597,688 | A * | 8/1926 | Moskovitz | A47F 5/00 | 211/4 |
| 2,879,898 | A | 3/1959 | Best | | |
| 3,924,749 | A * | 12/1975 | Weston | A47F 7/0246 | 211/169 |
| 4,757,906 | A | 7/1988 | Ovitz | | |
| 4,881,336 | A * | 11/1989 | Braverman | G09F 1/12 | 40/530 |
| 5,785,184 | A * | 7/1998 | Metselaar | E05B 69/006 | 70/59 |
| 7,481,323 | B2 * | 1/2009 | Fisher | B05B 13/0285 | 211/196 |
| 9,320,366 | B1 * | 4/2016 | Bertault | A47F 5/0087 | |
| 10,470,589 | B1 * | 11/2019 | Huynh | A47F 5/10 | |
| 10,849,448 | B1 * | 12/2020 | Bland | A47F 7/021 | |
| 2001/0008223 | A1 * | 7/2001 | Accatino | A47F 5/132 | 211/169 |

(Continued)

*Primary Examiner* — Gary C Hoge
(74) *Attorney, Agent, or Firm* — Overhauser Law Offices, LLC

(57) ABSTRACT

A product sample display structure holding multiple vertical shafts, each vertical shaft supporting a wing support bracket that may be positioned at a selected vertical location on the shaft. Vertically adjusting the wing support brackets allows the structure to hold wings of varying heights or from different manufacturers.

24 Claims, 24 Drawing Sheets

(56) References Cited

U.S. PATENT DOCUMENTS

| | | | | |
|---|---|---|---|---|
| 2003/0047528 | A1 | 3/2003 | Stein | |
| 2006/0131249 | A1* | 6/2006 | Kostigian | A47F 7/166 211/189 |
| 2007/0034585 | A1* | 2/2007 | Fisher | B05B 13/0285 211/189 |
| 2007/0262039 | A1* | 11/2007 | Biser | A47F 7/163 211/169 |
| 2012/0280093 | A1* | 11/2012 | Alicea | A47F 7/163 40/606.01 |
| 2018/0008063 | A1* | 1/2018 | Roan | G09F 15/00 |

* cited by examiner

DISPLAY SYSTEM FOR PIVOTABLE SAMPLES AND METHOD

CROSS REFERENCE TO RELATED APPLICATIONS

This is a continuation-in-part of application Ser. No. 17/835,333 filed Jun. 8, 2022, which application claims the benefit of U.S. Provisional Application Nos. 63/208,802 filed Jun. 9, 2021, 63/236,793 filed Aug. 25, 2021 and 63/321,789 filed Mar. 21, 2021, the contents of each of which are hereby incorporated by reference in their entireties.

FIELD OF THE INVENTION

The present invention relates to a product sample display system and method.

BACKGROUND

Many types of building materials and information such as carpet, wood flooring, laminate, vinyl, ceramic, tiles, rugs, other floor covering products, wall-paper, paneling, paint, cabinet doors, shingles and roofing products, as well as associated marketing information, pricing, etc., are displayed on loose samples or on page or board-type displays or rack and wing displays. These displays can be made of, for example, card stock, wrapped card stock, hardboard, styrene, formed or molded plastic products, wood, metal, or other materials. One or more wings holding such samples are typically attached to a display fixture or rack, including but not limited to, floor-standing or wall-mounted support devices using a short pin-long pin mounting method, rods, hinges, or other attachment means to secure the wings to the frame. The display device usually has a single array of wings, or one row of wings to a side, although in some instances, multi-tiered arrays of small wings are used.

Typically, all of the wings on the display device are approximately the same size and shape, often because the samples are supplied by a specific manufacturer that makes its wings and samples the same size. Usually, the long dimension of the wing forms the spine which is pivotally mounted to the display device. FIGS. 1 and 2 show representative prior art display systems. As is evident by these Figs., existing display systems limit the ability to display material or information on underlying wings of an array, since overlying wings of the array, typically being of about the same size and shape as the underlying wings, cover substantially all of the surface area of the underlying wings. Although a viewer typically can pivot the overlying wings out of the way to view an underlying wing, many consumers are reluctant to take time and effort to flip through an entire array to view the samples on every wing in a display. Moreover, many "impulse" buyers will not even bother to approach a display if a sample they might be interested in is hidden from view by overlying wings bearing material that they are not interested in.

Further, moving multiple wings in a display from one side to the other to display a selected wing can be difficult, because wings can be heavy and it may be necessary to move multiple wings. Existing displays also require a large and heavy base and structure because the wings themselves are heavy, the displays must be resistant to tipping over, and the displays must be able to withstand the force of the wings being pushed from one side of the display to the other. For this reason, existing display systems require a large of amount space, and in retail space, sufficient square footage is not economically available.

As noted, display systems are typically provided by product manufacturers, who also supply the wings or boards on which sample products are displayed. However, each display system usually holds only the wings or boards from the manufacturer that supplied the display system. This forces a retailer to display only models and styles of that manufacturer, even the low-volume styles that the retailer may not even stock. In addition, manufacturers regularly discontinue particular models or styles without replacing it when a new model or style. These samples must be removed from the display system, which results in unused capacity of the display system. While a retailer may prefer to populate the unused space with products of other manufacturers, the display system usually only accepts wings or displays of the manufacturer that supplied the display system. This results in suboptimal utilization of the display system by the retailer. It would be preferable to provide a universal display system that can accept wings or displays from any manufacturer, regardless of size of the wings or displays or how they are mounted onto the manufacturer-supplied display system. Such a system would allow a retailer to display only the wings or displays that provide the best return on investment for the retailer.

There have been multiple attempts to solve the display issues for samples. For example, U.S. Pat. No. 2,879,898 discloses a floor mounted rug display rack that includes a downwardly sloping support to allow rugs of various sizes to be displayed using one display device. Another purpose of the '898 Patent is to conserve floor space with the downwardly sloping design. However, a user would still need to lift each sample to fully view the sample underneath.

U.S. Pat. No. 4,757,906 discloses a display rack for flooring samples whereby a wire rack is used to create horizontal slots to display a sample folded into a u-shape between two of the slots. However, this requires the sample to be made from a bendable material, which is not the case for many building material samples. It also only allows the viewer to see a small portion of the whole sample.

Additionally, U.S. Patent Application No. 2003/0047528 discloses a display rack with multiple board sizes that allows dealers to use overlapping displays in which the top layer is the smallest and each subsequent layer is larger and extends past the first display. While this may seem to solve some of the issues in viewing multiple wings, the user still has to flip through each wing and will eventually have to move all of the wings back to their open position which can be heavy and cumbersome.

A display system should be able to be stable enough to hold multiple wings without tipping over or collapsing. It should also be modular so that multiple systems can be placed next to each other to make efficient use of floor space.

While the options in the prior art attempt to solve a few of the issues with current display product they have multiple limitations and none are user-friendly or space-saving.

SUMMARY OF THE INVENTION

One embodiment of the invention provides a display frame comprising multiple vertical shafts and a base; each vertical shaft having a wing support bracket that may be positioned at a selected vertical location on the shaft. The wing support brackets may be at the top, at the bottom, or at the top and bottom. The wing support brackets are vertically adjusted allow any sized display wing to be fitted into the display frame. There can also be multiple wing support brackets on a single shaft. These improvements allow wings of different heights, for instance from different manufacturers, to be held on the same display frame. They further allow groupings of wings by type (e.g., type of floor), subtype (e.g., material), color, manufacturer, etc.

Another embodiment of the present invention provides a display frame with a base and parallel vertical shafts in a curved configuration with wing stops. The wing stops limit the angle, from neutral, that each wing frame can pivot. The curved configuration may be a full or partial oval or circle with the base and support rings being full or cut to allow reconfiguration as desired to full, half, or quarter barrel configurations. The ability to use partial oval or circle base and support rings allows the display frame to be positioned around and/or adjacent to a building support column to optionally support the display structure. These improvements allow the display frame to hold more wings in a configuration that takes up less square footage. Further, the number of adjacent wings that are moved when an adjacent pair of wings is opened is limited, which allows multiple adjacent wings to be viewed by different people at different parts of the display frame at the same time. The curved configuration allows the user to use less force to move the wings since the curved arrangement limits the number of wings that must be moved simultaneously. Additionally, there is improved viewability since the adjacent wings in a non-linear display may be opened to a greater angle than in a typical linear display. In the present invention, the wings may be opened approximately 100°-150°. Finally, there is increased stability when attaching the display frame to an existing building column.

A further embodiment includes a mechanism to bias the wing frames of a display system towards a neutral position. For this embodiment, a display frame holding multiple adjacent wings includes a mechanism to bias the wing frames toward the neutral position if the wing frame is close to neutral position (e.g. ≤15°) or toward the open position if the wing frame is close to a not near neutral position (e.g. more than 15°). This feature eliminates the need for a salesperson to manually move the wing frames to a neutral position after a consumer has viewed a display. Further, no wing will abut an adjacent wing (when all wings are in the neutral position) so some part of each wing is viewable without having to move any wing. Finally, this allows for an increased aesthetic appearance.

A display system of the present invention may be spaced around a building support column optionally using abutting displays by attaching S brackets to abutting displays as described in FIG. 28. In this embodiment, at least two opposing sides would be equipped with wing support brackets. This may allow a smaller base with a lighter support structure that is sturdy and not likely to tip over.

Using a display system with battery-operated overhead lights can also help improve a display system. The system may be provided with multiple groups of adjacent wings having a common feature or each individual system would have a common feature. For example, the common features could include manufacturer, flooring type, flooring sub-type, color, etc. The user could have multiple sets of battery-operated lights on the same display system with each set shining a different color of light on each of the groupings. This would make it easier to locate flooring samples having a desired feature. It also allows displays to be located where a wired power source is not available or easily accessible.

Integrating a display system with QR codes for each display or wing integrated with an information provision system allows for easier shopping for the customer and eliminates a lot of unnecessary work for the seller. For example, each wing may have a barrel (display) identifier, a wing identifier, sample identifier, and a QR code. A database is provided that associates the QR code with information about the product displayed that is associated with the display identifier, wing identifier, and sample identifier. Some of the information that may be provided includes price, availability status, backorder status, discontinued status, and similar products. This database would be available via a hardware and software system that is operable to display the information associated with a scanned-in QR code. The hardware and software system may also be able to accept quoting and ordering information and generate pricing information for the product quoted or ordered. The hardware may be a smartphone, tablet, or any other hardware that is equipped with QR reader capabilities.

The system may also include a database having identifiers for multiple store locations. The system further includes a means for receiving geolocation information from the hardware used to input quoting or ordering information and a means for quoting pricing information based on the received geolocation information. These improvements eliminate the need to manually update pricing on displays, allow a consumer to receive information and quotes without the assistance of a salesperson, collects information about each consumer that scans a QR code, and allows deployment of the system in multiple locations.

Another aspect of the present invention is a system that biases the wings toward a neutral position. A display structure, not necessarily in a curved configuration, holding multiple pivotable wings may be made whereby each wing is positionable in a neutral position in which the wing does not abut or contact any adjacent wing. The structure would further include a means biasing each wing toward its neutral position. This permits easier viewing of a portion of each wing because adjacent wings are not abutting, which allows viewing of each wing. It also reduces the amount of force required to fully open and display a desired wing when all wings are in their neutral position because adjacent wings will not need to be moved as a user begins to move the desired wing to a displayed position.

A further option includes the use of a display frame holding a plurality of pivotable display wing frames with a stop means connected to the wing frame for each wing operable to limit the extent to which each wing may pivot. This reduces the amount of force required to fully open and display a desired wing because the adjacent wings can only be opened to a limited extent. This means the adjacent wings cannot put their full force on the desired wing making it lighter and easier to open. The stop means may include the point at which the wing frame hits the edge of the wing support bracket, thereby not allowing the frame to rotate any further.

Another embodiment of the present invention includes a non-neutral position holding mechanism such as a magnet, detent, or some other suitable means to hold the wing frames in a non-neutral position. The holding mechanism allows the wing to be kept in its displayed position without the user holding it open. This may be accomplished with a magnet affixed to the wing support bracket and the wing frame being comprised of a material attracted by the magnet. Another option is using a small detent in the wing support bracket with a small bulb on the wing frame that fits within the detent and is removable with a small amount of force. This improves the viewing of the wings because they will remain open and not be affected by gravity or inadvertent movement of the wing frame.

A further embodiment of the present invention may be manufactured using vertical shafts. Each vertical shaft may have a plurality of holes, or vertical wing adjustments, along its length at set intervals, such as a hole every ¾" along the length. A wing support bracket may placed over the vertical shaft and can be adjustably held in place against the vertical shaft. One option for holding the wing support bracket in place is by sliding a pin through a hole in the wing support bracket and the vertical shaft. Further, the wing support bracket may rest on a pin placed through a hole in the vertical shaft. The wing support bracket may also have wing stops that limit the extent to which the wings may open and/or magnets on the sides of the wing support bracket that hold the wing frame open.

A further embodiment comprises wing support brackets that have notches to allow them to mounted on or removed from threaded shafts at any desired vertical location. Nuts and washers may be mounted on a threaded shaft and moved to the vertical location where it is desired to mount a wing support bracket. Notches in the wing support bracket may be fitted around threaded shaft, and then secured to the shaft with the nuts and washers. Separate holds or pegs in the wing support bracket allow the wings or display of different heights to be mounted on the display system.

A further embodiment comprises a clamp having two arms with block on each arm. The combination of the clamp arms and blocks securely hold a wing or display to the clamp. The use of the clamp allows the system to hold a wing or display of virtually any manufacturer. In one embodiment, the block is provided with two perpendicular slots, each of which is offset from the midlines of the block by a different amount. By selecting the orientation of the block when placing it over an arm of clamp, it is possible to select the size of the gap between the blocks. This allows the clamp to securely hold a wing or display board regardless of the thickness of the wing or display board. This is desirable because the thickness of wings and display boards vary greatly between different manufacturers, and the ability to accommodate different widths allows virtually any wing or display board to be mounted on the display system.

DETAILED DESCRIPTION

Figure 3:
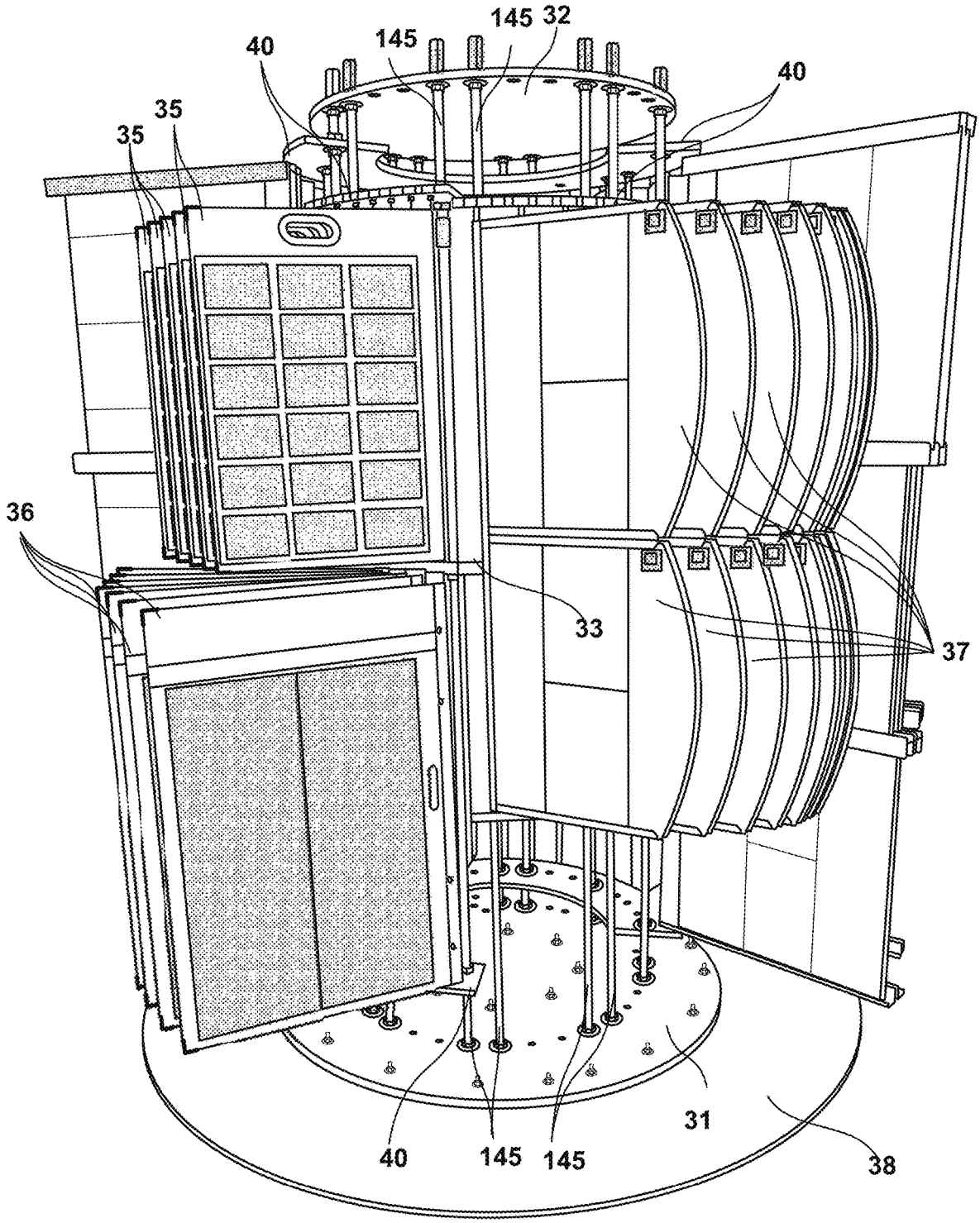
FIG. 3 shows a display system with multiple vertical shafts in a circular orientation and height-adjustable wing support brackets on different vertical shafts to display wings of varying heights.

As shown in FIG. 3, disclosed is a display frame comprising multiple vertical shafts 145 that extend between a bottom support base 31, a top support 32, and an optional central support 33. In one embodiment, the vertical shafts are arranged in a circular or arcuate orientation.

Figure 1:
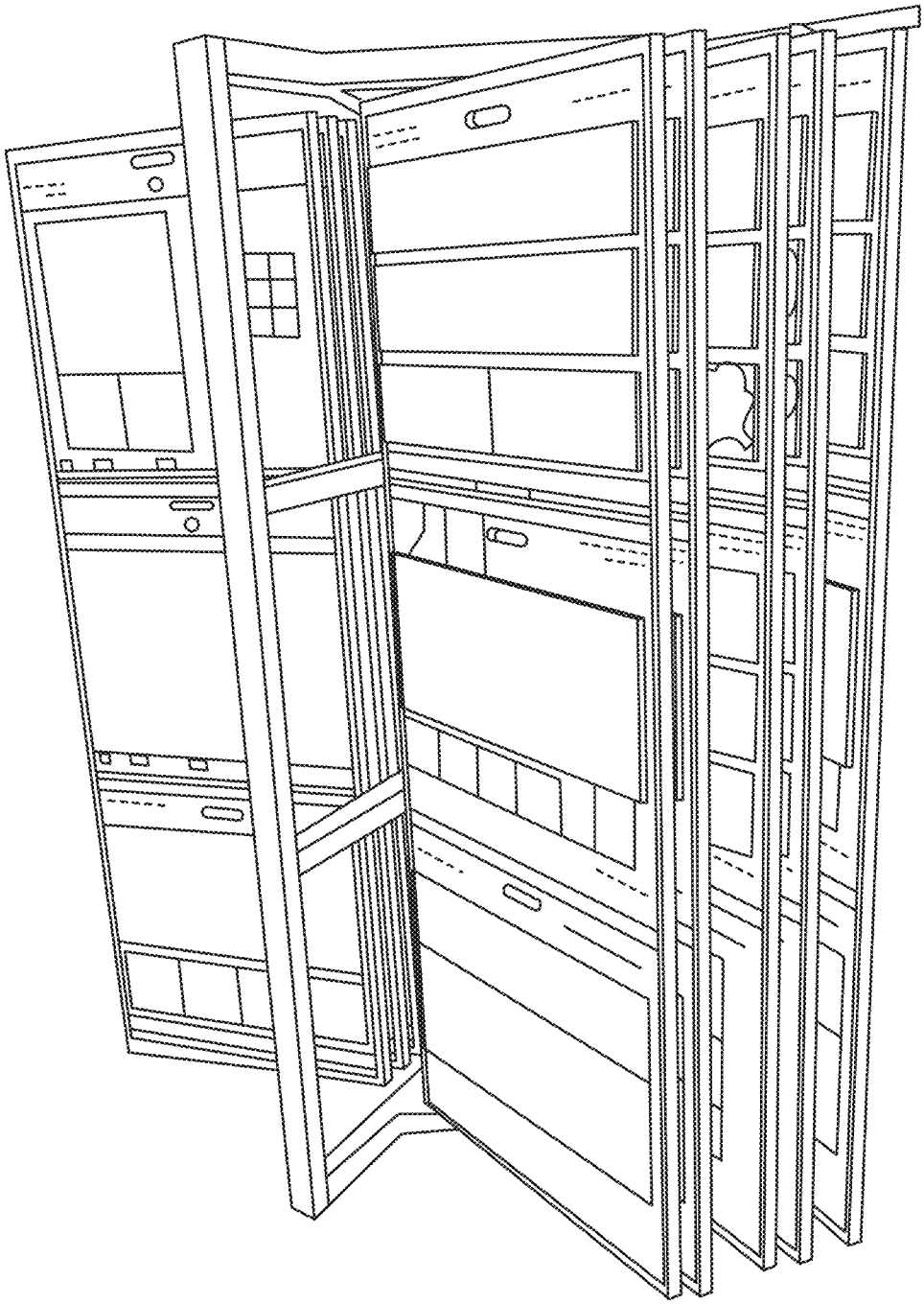
FIG. 1 (Prior Art)
FIG. 1 shows a representative prior art display system holding triple-height display boards in which six display boards (three on each side) are on each wing. Thus, pivoting one wing moves six display boards.
Figure 2:
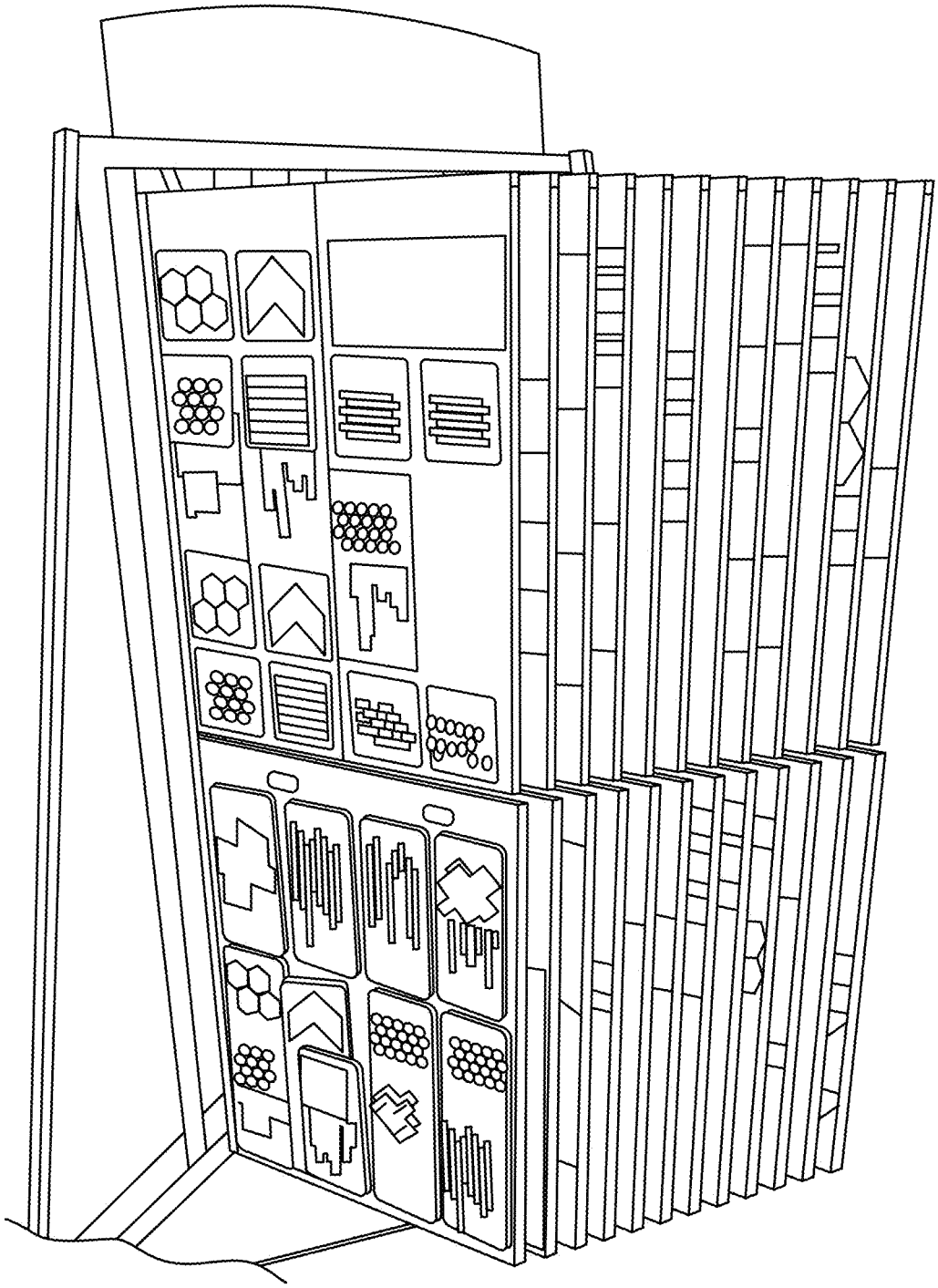
FIG. 2 (Prior Art)
FIG. 2 shows a representative prior art display system holding upper and lower sets of display boards in which two display boards (one on each side) are on each wing. An upper wing may pivot independently the wing below it.

Wing support brackets 40 are mounted on the shafts, and can be positioned at any vertical point along the shafts 145. This allows the system to hold display wings 35, 36, 37 of different heights, which may be from different manufacturers. This allows the display system to be much more versatile than existing systems which typically only accommodate display wings that are the same height, as shown in FIGS. 1 and 2.

The wing support brackets 40 may be at the top, at the bottom, or at the top and bottom of the wing frames. The wing support brackets are vertically positioned on threaded shafts having nuts to set the height. The top 32, bottom 31 and central 33 supports may also serve as wing support brackets. In lieu of nuts on the shafts to hold wing support brackets, clamps may be attached to the vertical shafts to set the position of the wing support brackets. Multiple wing support brackets may be positioned on a single shaft. These improvements allow wings of different heights, for instance from different manufacturers 35, 36, 37, to be held on the same display structure. They further allow groupings of wings by type (e.g., type of floor), subtype (e.g., material), color, manufacturer, etc., as exemplified in FIG. 3.

Figure 13:
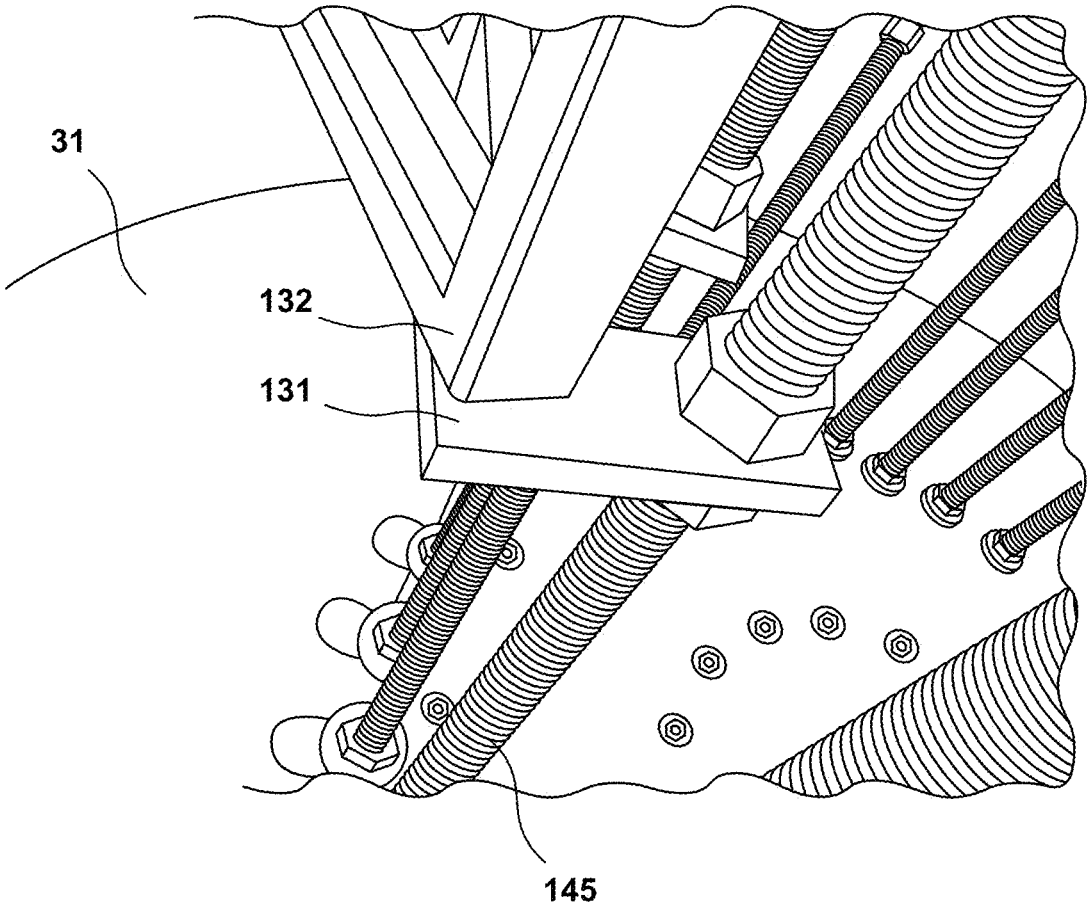
FIG. 13 is a perspective view of a small display wing support bracket sized to hold a single wing or display board.

FIG. 13 is a perspective view of a small display wing support bracket 131 sized to hold a single wing or display board 132. The support bracket 131 may either have a notch or hole that receives vertical shaft 145. The wing or display board 132 may pivot on support bracket 131, either by virtue of hole in support bracket 131 that receives a peg extending from display board 132, or a peg in support bracket 131 that is inserted into a hole in display board 132. Support bracket 131 is positioned at a desired vertical location on vertical shaft 145 and is held in place by washers and nuts above and below the bracket.

Figure 4:
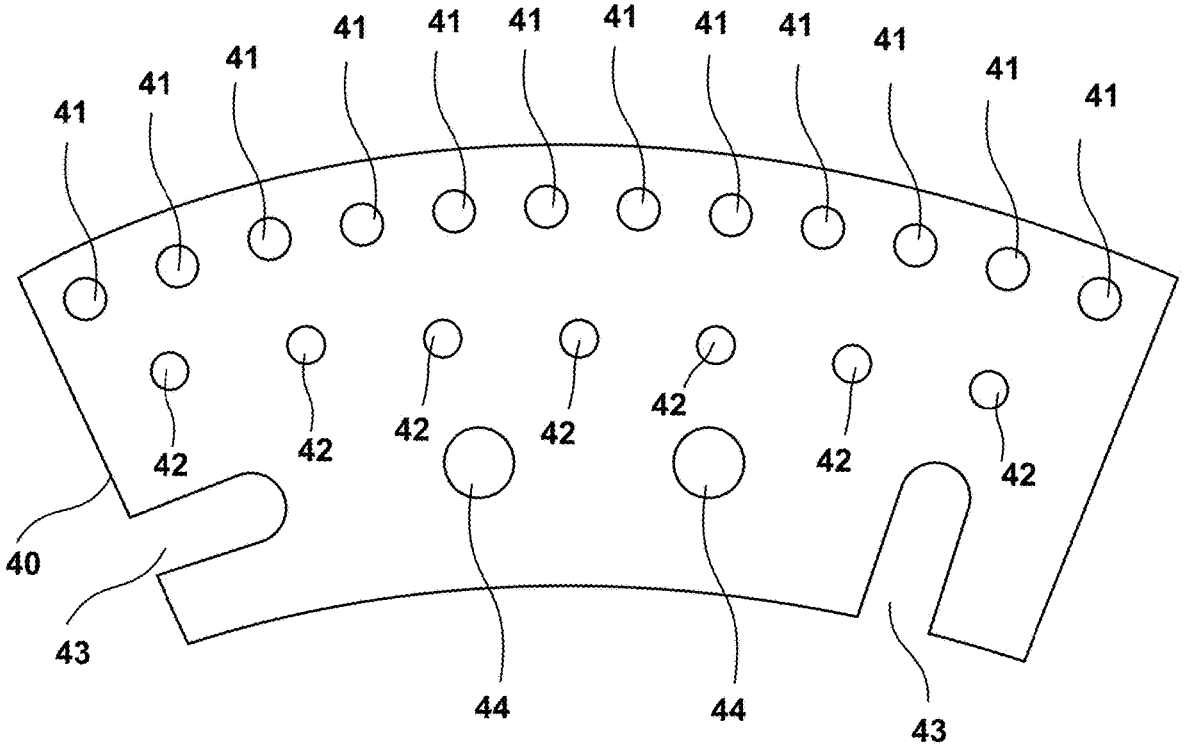
FIG. 4 shows a display wing support bracket having holes or notches to attach it to vertical shafts at a desired height, and, a variety of holes or pegs to receive pivotable display wings.

As shown in FIG. 4, To facilitate positioning the wing support brackets on the shafts, the brackets have holes 44 or notches 43 that engage the vertical shafts. If holes 44 are used, they need to be placed over the shafts as the display system is being constructed. Thus, it is preferable to use notches 45 instead. Notches 43 allow the wing support bracket to be mounted on the vertical shafts after the display system has been constructed; i.e., after the vertical shafts are mounted to the bottom support base and the top support. FIG. 4 shows a top view of such a wing support bracket 40 that has both notches 43 and holes 44. Regardless of which option is used, wing support bracket 40 may be securely mounted to vertical shafts at a desired height by nuts and bolts positioned immediately above and below the wing support bracket 40.

In the display system shown in FIG. 3, the notched display support brackets as shown in FIG. 4 are used. The display support bracket shown in FIG. 4 has an outer row of holes 41 and an inner row of holes 42. Each of these holes can hold a display wing. A retailer may choose to use the holes 41 in an outer row for displays that are not deep (or wide), and holes 42 in an inner row for displays that are deeper. For example, in FIG. 3, the displays 35 are not as deep as the displays 36. This selection allows the outer edges of the display wings to be closer together.

Figure 5:
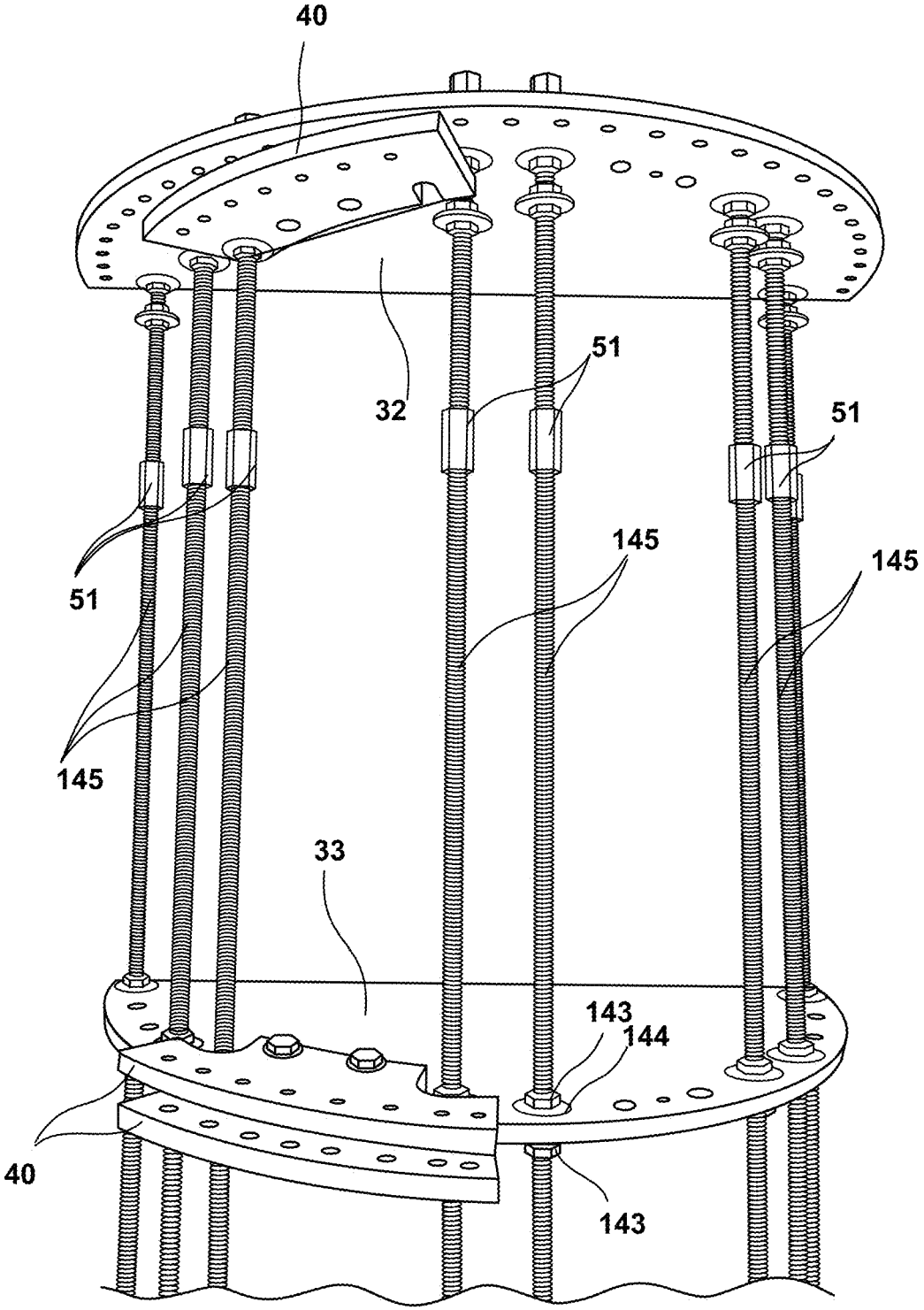
FIG. 5 shows the top and central support structures of a semi-circular display system, and how display wing support brackets may be mounted on either vertical shafts or the central support structure.

FIG. 5 shows a display system with the display wings removed, to show how the wing support brackets may be mounted on the vertical shafts at various places.

Figure 6:
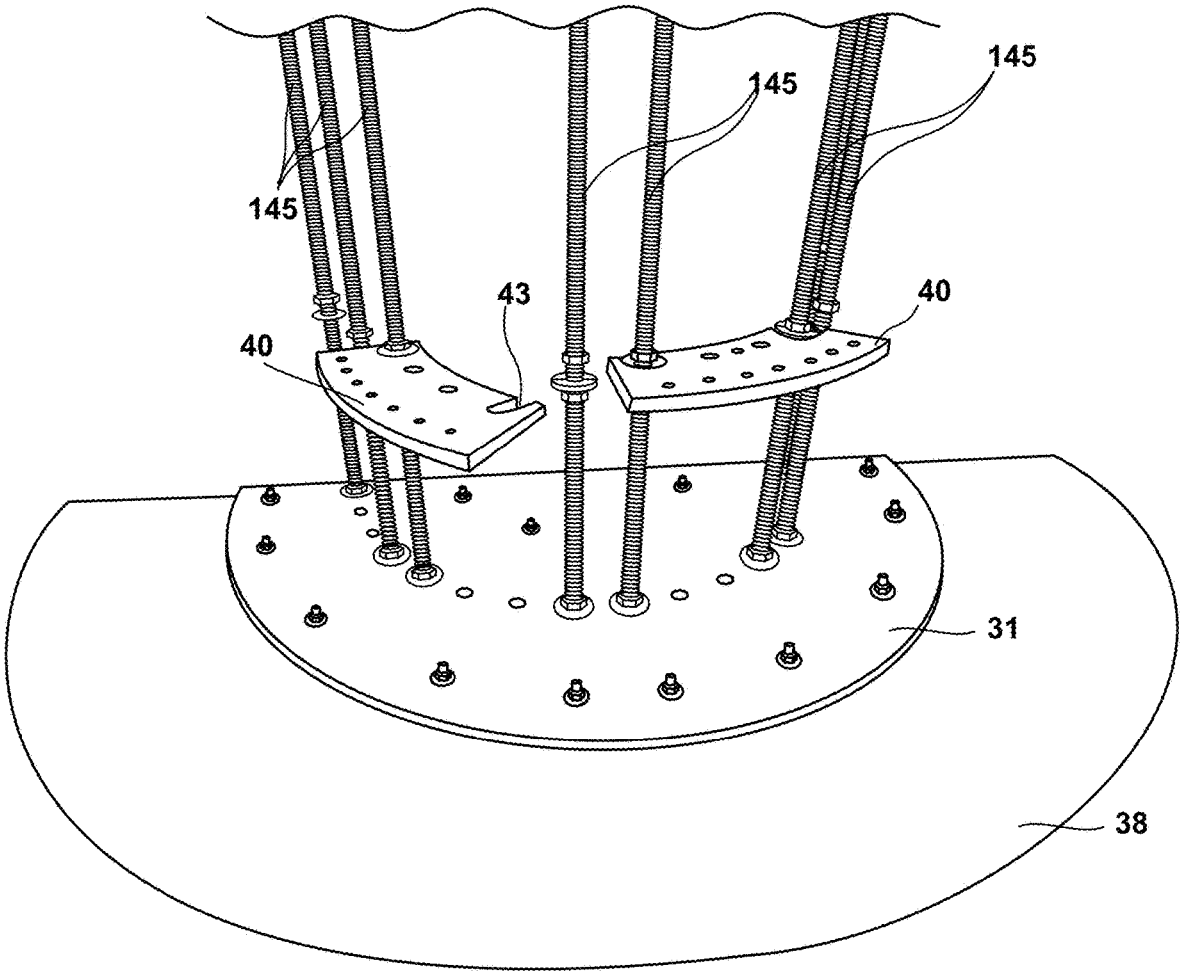
FIG. 6 shows the lower part of a semi-circular display system, and how notches in display wing support brackets may be mounted on or removed from vertical shafts.

FIG. 6 is another view showing how a wing support bracket having a notch as shown in FIG. 6 may be pivoted to abut the vertical shafts, then secured in place using nuts on washers mounted on the vertical shafts.

Display wings from some manufacturers have a peg that extends downward from the lower back of the display to fit into a hole in the display system, and/or a peg that extends upward from the upper back of the display to fit into a hole in the display system. Display systems from other manufacturers have a displays with holes at the bottom and top of the back that receive pegs extending from the display system. Both configurations allow the display to pivot along its back edge so a consumer may view both sides of a selected display. The present system permits either system to be used. As shown in FIGS. 4 and 6, the wing support brackets are provided with holes sized to receive pegs from display wings that have pegs. If a display wing instead has holes, the equivalent of a peg may be formed in the display support bracket by bolting a short threaded bolt to one of the holes in the in wing support bracket.

Figure 7:
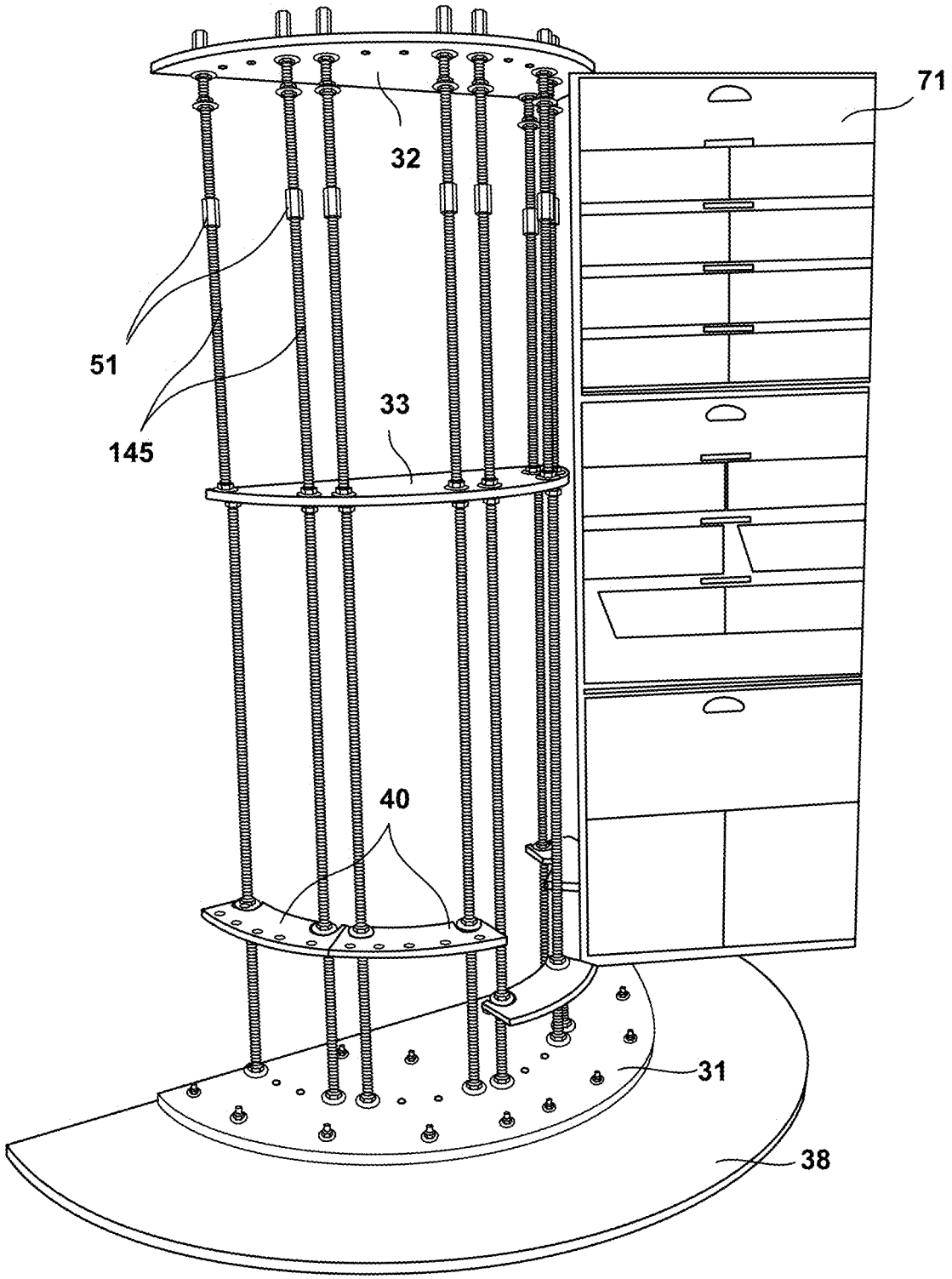
FIG. 7 a partially populated display system in which a tall wing is held by a wing support bracket at one height, and how other wing support brackets may be positioned at different heights.

FIG. 7 shows another embodiment of a display system. In this version a display support bracket holds the bottom of a display wing, and the top of the display wing is held by the top support. Other display wing brackets are mounted on the threaded shafts and can be at different heights to accommodate display wings of different heights.

Sample display wings from manufacturers typically include a board, and a structure for mounting the board to the display system. Structures for mounting may include a channel along the back edge of the board that has receives pegs extending from a display, or pegs extending from the top and bottom of the board that fit into holes in a display. Moreover, boards from different manufacturers may be of different widths. The different types and sizes of structures used by different providers of the boards, and the different thicknesses of the boards, complicate the ability to provide a display that can hold boards of any manufacturer. Presently disclosed is a clamp system designed to hold display boards from any manufacturer, including boards of different thicknesses.

Figure 8:
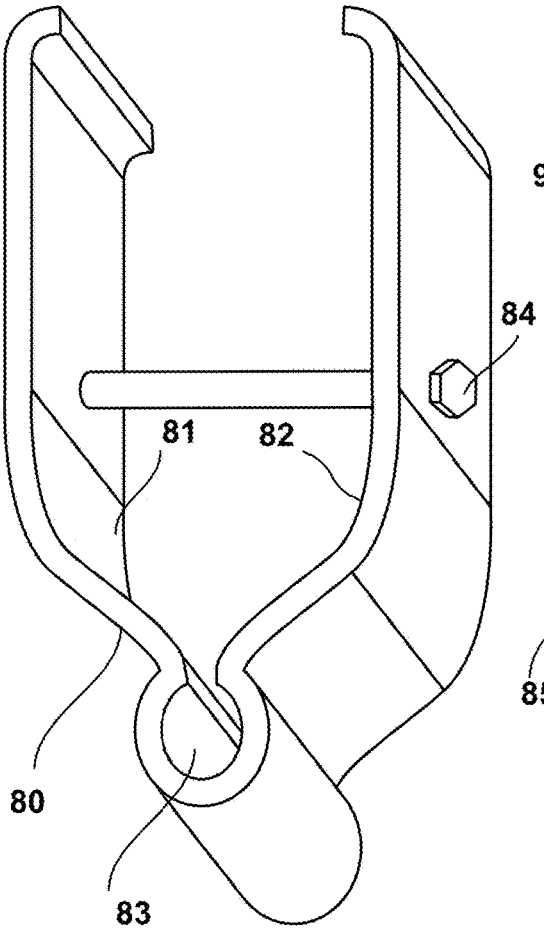
FIG. 8 is a perspective view of clamp for holding a wing or display board having a channel for mounting onto a peg.
Figure 9:
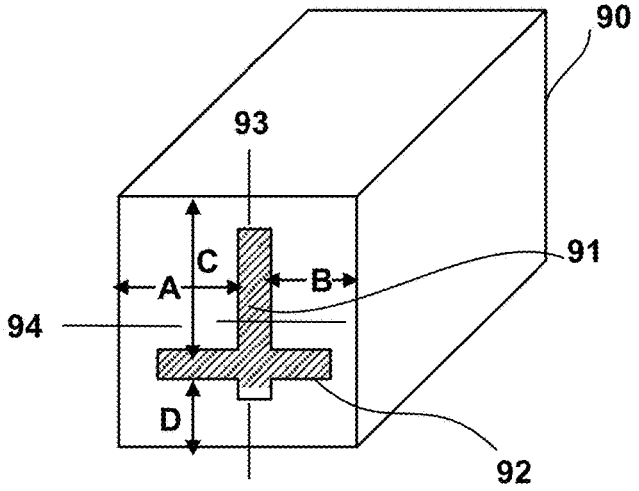
FIG. 9 is perspective view a compressive block have two perpendicular slots that are each offset from the midline of the block by a different amount. The slots may be fitted over the arms of the clamp in FIG. 8.

FIG. 8 is a perspective view of a clamp 80 having left and right arms, 81, 82 each of which has a first end and a second end which are joined at channel 83. This allows the arms to flex toward each other. Clamp 80 also includes a tightening mechanism such as threaded bolt 84 which may be tightened to compress arms 81, 82 toward each other. The clamp system also includes two compressible blocks as shown in FIG. 9. Each block 90, which may be comprised of rubber, has two perpendicular slots, 91 and 92, each of which is sized to accommodate an arm 81, 82 of clamp 80. The slots extend from the front side of the block to the back side. Significantly, the slots may have distances from their parallel sides that are different, in other words, they are offset from the midlines 93, 94 of the block. Thus, by selecting the orientation of the block when placing it over an arm 81 or 82 of clamp 80, it is possible to select the size of the gap between the blocks.

As shown in FIG. 9, vertical slot 91 is slightly offset (to the right) of vertical midline 93, and horizontal slot 92 is offset (below) horizontal midline 94. For example, the distance A between the left side of the block and the vertical slot may be ½ inch, and the distance B between the vertical slot and the right side of the block may ⅜ inch. Similarly, the distance C between the top of block and horizontal slot 92 may be ⅝ inch, and the distance D between horizontal slot 92 and the bottom of the block may be ¼ inch. In one embodiment, the inside distance between clamp arms 81 and 82 may be 1⅜ inch. Thus, by selecting which slot of the block to use and which side will be inside the clamp arms, the gap between the insides of the block may be any where from ⅛ inch to ⅞ inch.

Figure 10:
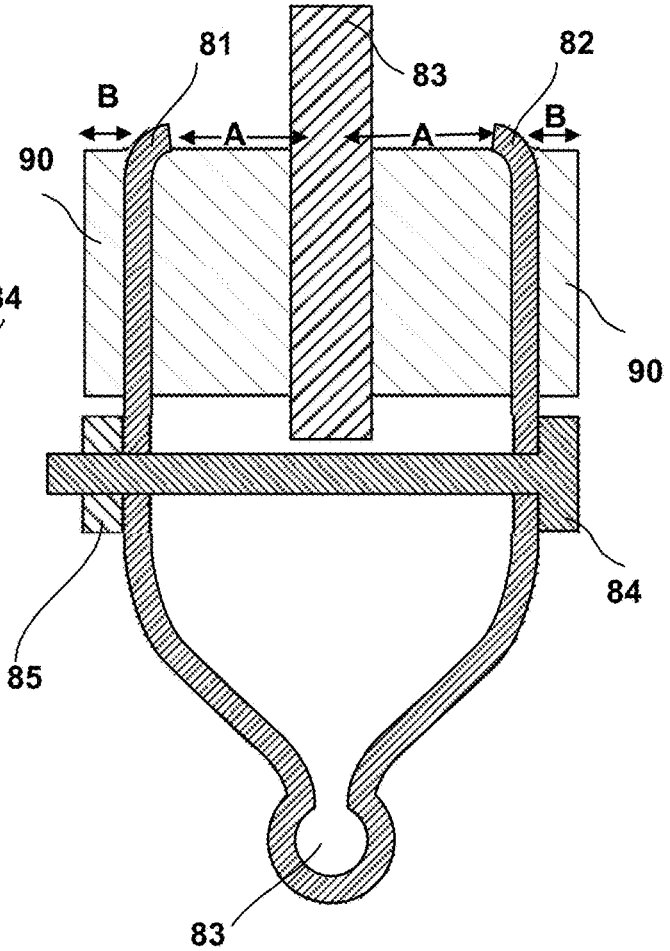
FIG. 10 is a top cross sectional view of a clamp of FIG. 8 having mounted on each arm a block as shown in FIG. 9 to hold thin display board.
Figure 11:
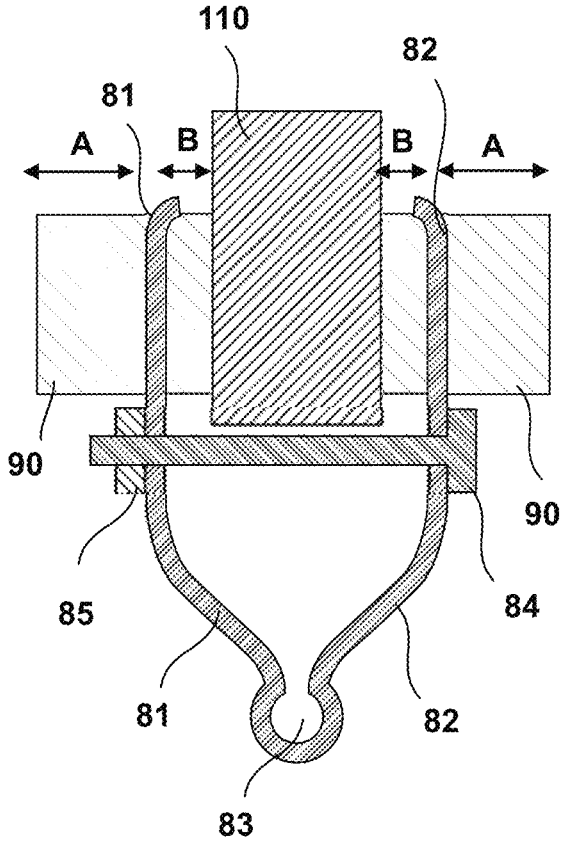
FIG. 11 is a top cross sectional view of a clamp of FIG. 8 having mounted on each arm a block as shown in FIG. 9 to hold thick display board.

These variations are shown, for example, in FIGS. 10 and 11 which are top cross section views of clamp 80 having a block on each arm 81 and 82. In FIG. 10, blocks are positioned so that a ½ inch portion of each block is between the clamp arms, and a ⅜ inch portion is on the outer side of each clamp arm. This allows the clamp to securely hold a board 83 that is ⅜ inch thick. In FIG. 11, blocks are positioned so that a ⅜ inch portion of each block is between the clamp arms, and a ½ inch portion is on the outer side of each clamp arm. This allows the clamp to securely hold a board 110 that is ⅝ inch thick.

Figure 12:
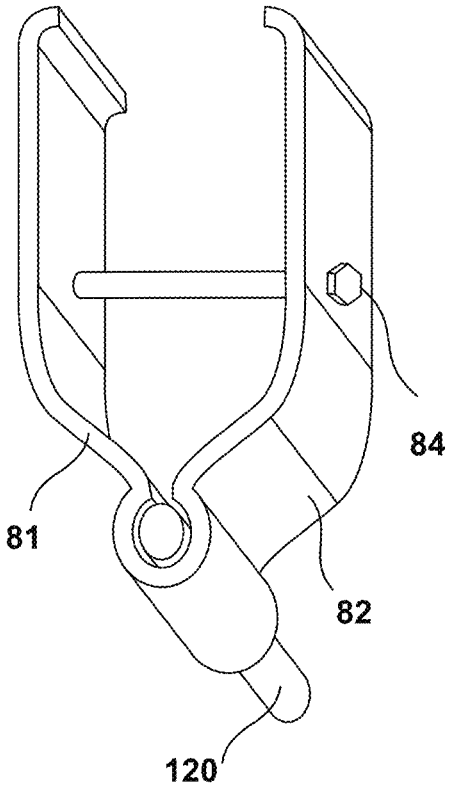
FIG. 12 is a perspective view of clamp for holding a wing or display board having a peg mounting onto a hole in a support bracket.

Blocks are preferably comprised slightly compressive material such as rubber or nylon. By tightening bolt 84 after the blocks are mounted on the arms and the board is positioned between them, the display board is securely held by the clamp and may be mounted in the display system. In the clamp version shown in FIGS. 8, 10 and 11, channel 83 may be inserted into a peg extending from the display system to allow the board to pivot about the peg. Alternatively, as shown in FIG. 12, in lieu of channel 83, the clamp may comprise a peg 120 sized to fit into a mating hole in the display system to hold the board.

Another aspect of the present invention is a system that biases the display wings toward a neutral position. A display structure, not necessarily in a curved configuration, holding multiple pivotable wings may be made whereby each wing is positionable in a neutral position in which the wing does not abut or contact any adjacent wing. The structure would further include a means biasing each wing toward its neutral position. This permits easier viewing of a portion of each wing because adjacent wings are not abutting, which allows viewing of each wing. It also reduces the amount of force required to fully open and display a desired wing when all wings are in their neutral position because adjacent wings will not need to be moved as a user begins to move the desired wing to a displayed position.

Figure 14:
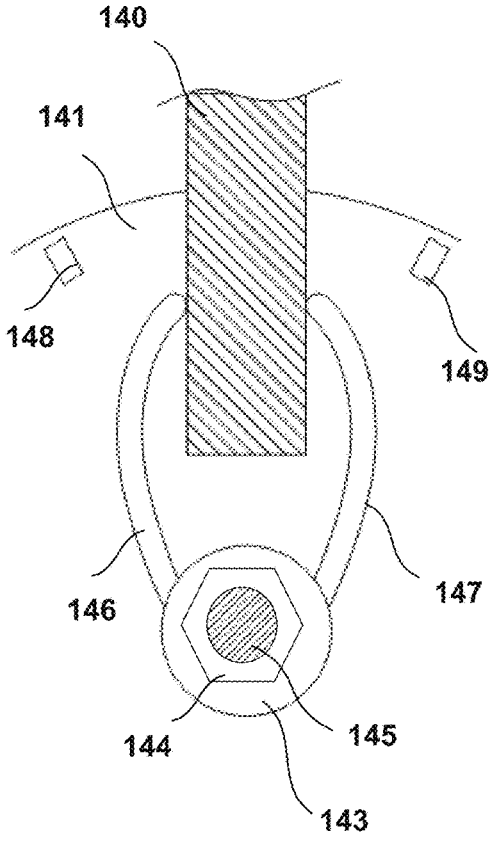
FIG. 14 is a partial top cross-section view of the bottom part of a display wing mounted on display wing support bracket with two spring arms that bias display wing toward a neutral position.
Figure 15:
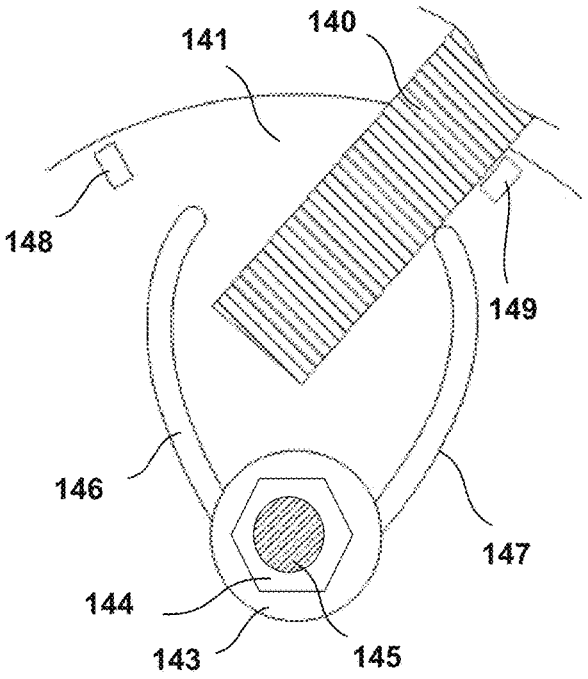
FIG. 15 is a partial top cross-section view of the bottom part of a display wing mounted on display wing support bracket with two spring arms, in which the wing is pivoted to a non-neutral position and held by a magnet mounted on the bracket, and in which the magnet also acts as a stop.

One option for a spring system used to bias each display frame towards a neutral position is shown in FIGS. 14 and 15. FIG. 14 is a partial top cross-section view of the bottom part of a display wing 140 mounted on display wing support bracket or surface 141. Washer 143 and nut 144 hold the bracket or surface at a selected vertical position on threaded shaft 145. As shown in FIG. 14, the washer and nut also hold a spring having two arms 146 and 147 which bias display wing 140 towards a neutral position, such as extending radially outward from the center of the display system. A consumer may pivot a display wing to one side to view it as shown in FIG. 15. In this instance, one of the arms 147 is deflected in the direction of the movement. The position of the display wing can be held in this position by means such as a magnet as described below. When the display wing moved from this open position toward the neutral position shown in FIG. 14, arm 147 of spring will return the display wing 140 to its neutral position.

The display wing support bracket or surface 141 may also be provided with left magnet 148 and right magnet 149, which also act as stops that limit the extent to which the display wing 140 may be pivoted from its neutral position. When display wing 140 is pivoted to the position shown in FIG. 15, right magnet limits the pivoting and also holds the display wing 140 in the pivoted position by magnetic force. When the consumer is finished viewing the display wing, he or she simply slightly pushes it toward the neutral position with enough force to overcome the magnet force, and the spring arms 146 or 147 will return the display wing to the neutral position. Spring arms 146 and 147 may be comprised of any suitable material that is flexible yet maintains consistent shape, such stainless steel.

Another option is using a small detent in the wing support bracket with a small bulb on the wing frame that fits within the detent and is removable with a small amount of force.

When the vertical shafts are positioned in a non-linear or curved configuration, the viewing area of the wings is greater than in the prior art. As shown in FIG. 3, the adjacent wing frames/display boards 35, 36, 37 are able to open to an angle of approximately 150° if so desired. However, it may also be desired to have wing stops that limit the extent to which the wing frames may open. This would be helpful if multiple customers were looking at the same display at the same time in different sections. Therefore, the neighboring wings would not be collapsed on one another making it more difficult to view the desired wing.

FIG. 3 shows a display system including a round base plate 38 and round inner support plate 31. These may be a full or partial oval or circle with the base and support rings being full or cut to allow reconfiguration as desired to full, half, or quarter barrel configurations. The ability to use partial oval or circle base and support rings allows the display system to be positioned around and/or adjacent to a building support column to support the display structure. Connecting the display frame to an existing support column increases the stability and allows the product to have a lighter and smaller base as the column will be able to absorb some of the weight and/or force of the display.

Figure 16:
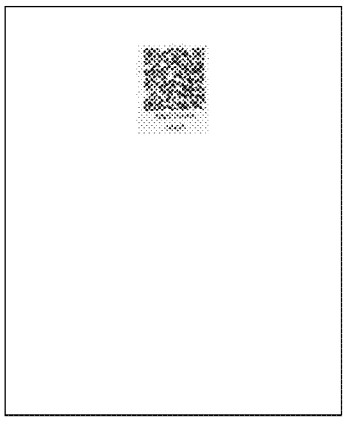
FIG. 16 shows a representative display board having a QR code.
Figure 17:
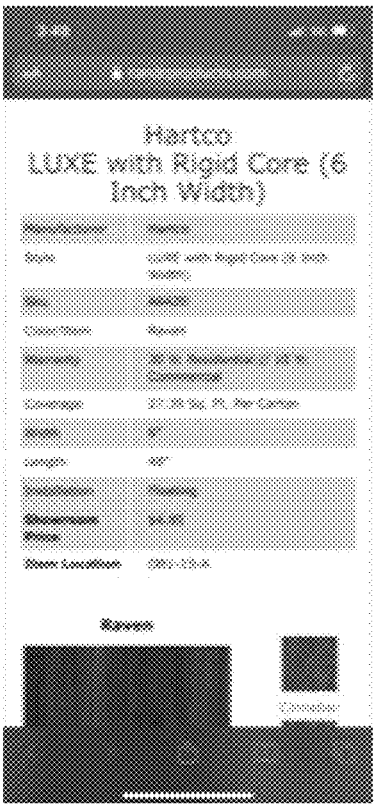
FIG. 17 is a first exemplar of the information displayed using the QR code, hardware, and software system.
Figure 18:
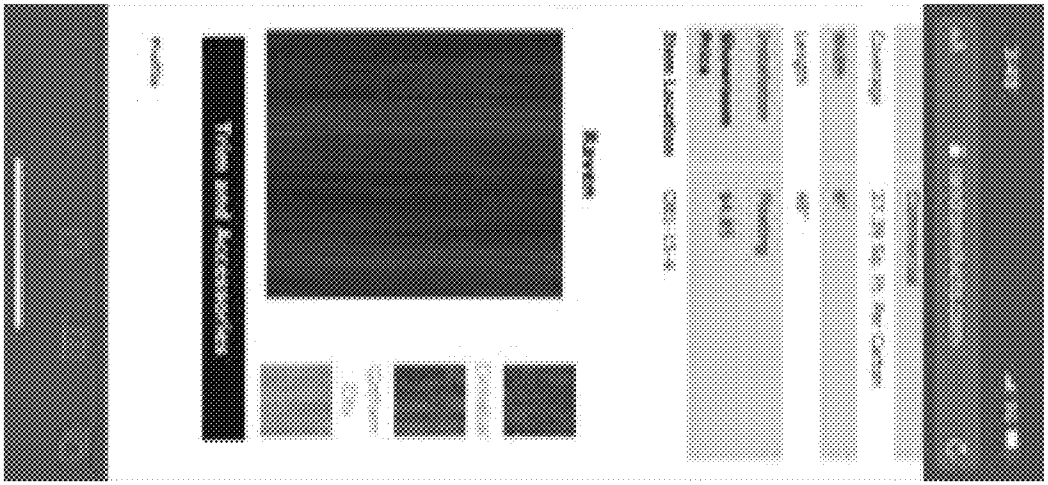
FIG. 18 is a second exemplar of the information displayed using the QR code, hardware, and software system.

The display boards may also bear a sticker having a QR code, barrel (display) identifiers, wing identifiers, and sample identifiers as shown in FIG. 16. When a customer scans the QR code using a QR code reader, like a smartphone, the hardware will connect with the software and provide related information to the customer as shown in FIGS. 17 and 18. That information can include price, availability status, backorder status, discontinued status, and similar products amongst any other information programmed into the database that communicates with the software. A customer may also receive a quote or place an order through a webpage or app displayed in response scanning the QR code.

The QR system may also include a database having identifiers for multiple store locations. One embodiment of the system further includes a means for receiving geolocation information from the hardware used to input quoting or ordering information and a means for quoting pricing information based on the received geolocation information. Once a QR code is scanned, the seller or dealer may also receive information about the customer, such as which codes they have scanned and therefore which types of flooring they may be interested in.

Other options for allowing the wing frame to be held open at a stopping point include a small detent in the wing support bracket with a corresponding notch on the wing frame, similarly corresponding Velcro pieces, or any other suitable means that would allow for stopping and releasing the wing frame with minimal force.

It is desirable for a customer to be able to view both sides of the product display wings with minimal effort without removing the sample from the display, and for the display system to hold product samples of various sizes, weights and types. Typical product display wings may be 2.5 ft. wide or smaller, a height of 6 ft. and be from ¼" to 2" thick. The types of products that may displayed on a display wing include carpet, hardwood, laminates, ceramic, vinyl, many other flooring products, roof shingles, windows and window treatments and other products. Many of these products can be displayed at the same time on the same display.

The display system may be freestanding, so it does not require connection to a wall, support column or other structure.

Product display wings can be adjusted vertically to any desired height by adjusting the location of product wing support brackets on threaded shafts. Because threaded shafts are used, any desired vertical location may be achieved, as threaded nuts on the shafts can be rotated to any desired height. This allows different display wings to be easily swapped into or out of the system as product needs change, without the need to purchase different displays.

In one embodiment, the display system can have a quarter-circle footprint, which can be especially ideal for an interior corner in a showroom. The quarter circle footprint also allows two systems to be placed in abutting relationship to create a semi-circular display, or four systems may be used to create a circular display. These space-conserving designs can reduce the floor space needed for product displays by 30 percent or more.

The optional use of an upper bracket also allows optional lights to be installed to provide additional light for the products on the display wings.

In one embodiment, a full circular display may have a structural load capacity of approximately 2,500 lbs. Leveling features may be built into the baseplate or legs of the display to accommodate uneven floors. Pads may be mounted to the base support structure to protect showroom flooring. In one embodiment, a bolt extends from an hole in the top of the leg. Threaded onto it in an intermediate position is a locking nut with a nylon insert. The bottom of the bolt is attached to a rectangular levelling plate that is slightly smaller on each side than the width of the leg and is surrounded by the leg. The bottom of the levelling plate may be glued to carpeting so it does not mar the floor of the showroom. The bolt may be rotated to move the levelling plate and the leg to which it is attached up or down as needed to accommodate variances in floor height.

Figure 19:
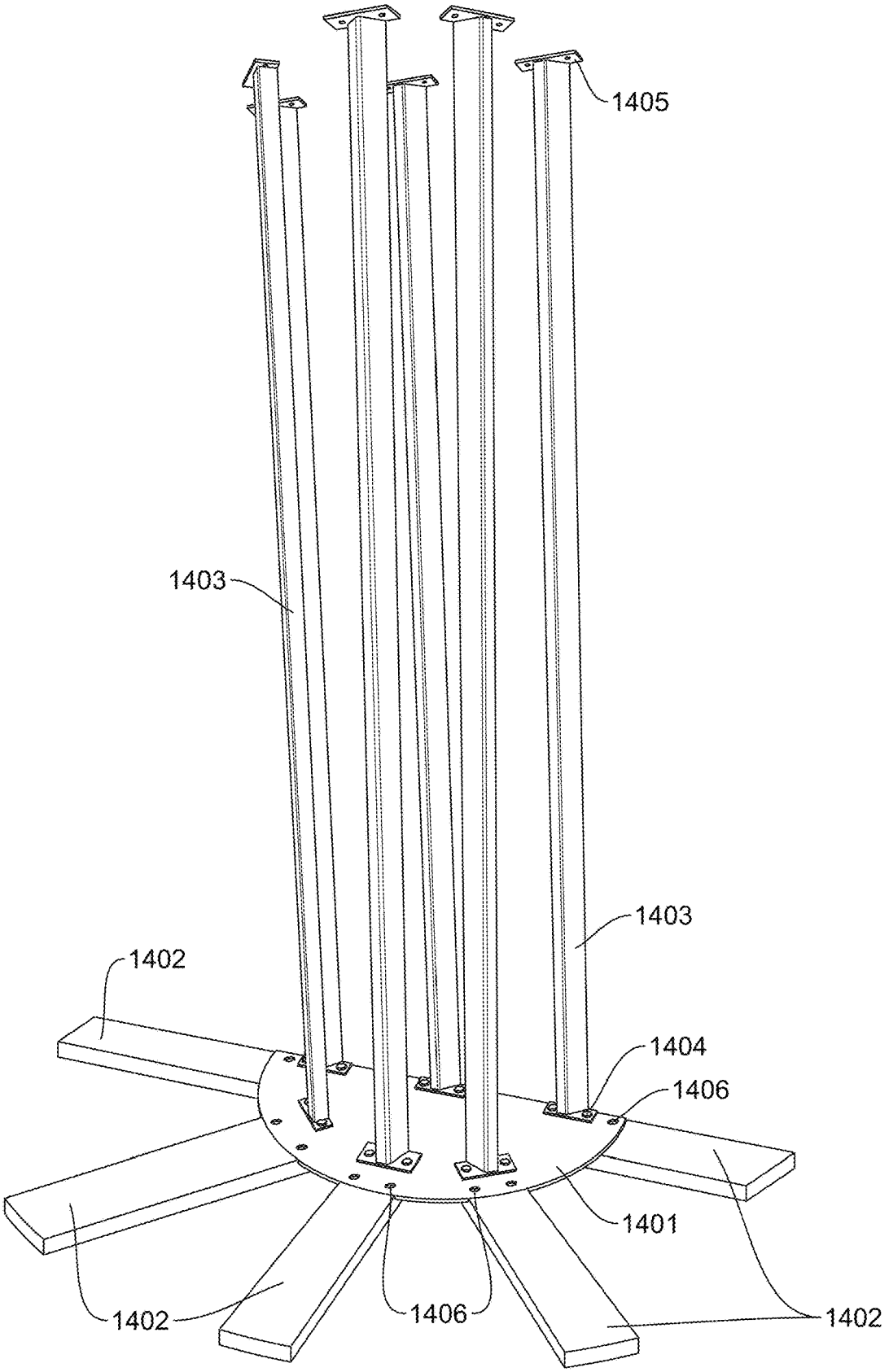
FIG. 19 is a second exemplar of components of a display system including rigid support structures.

FIG. 19 is an exemplar of components of a display system including rigid support structures. Semi-circular steel baseplate 1401 includes legs 1402 which impart stability to the display system and prevent tipping when the display is loaded with display wings as shown in FIG. 3. A plurality of rigid support structures 1403 may be comprised of steel angles and are attached to baseplate 1401 and 1402, such as by being welded to rectangular plate assemblies 1406 which in turn are bolted to baseplate 1401, or otherwise connected as described herein. Baseplate also includes holes 1406 to receive threaded rods.

Figure 20:
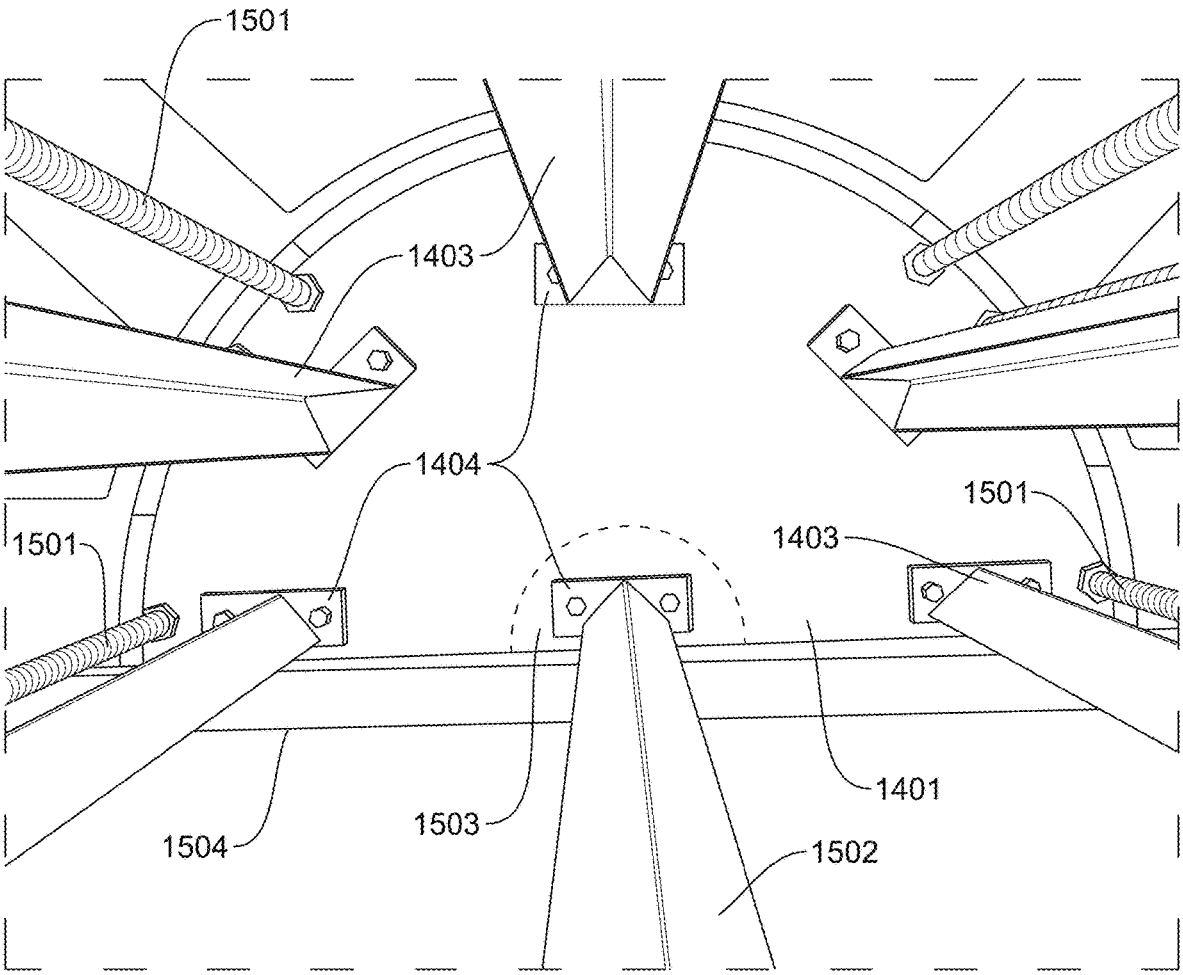
FIG. 20 is a downward looking view from the middle of system showing the locations of a center area in a baseplate, rigid support structures, and threaded shafts.

FIG. 20 is a downward looking view from the middle of system showing the locations of a center area 1503 in baseplate 1401, rigid support structures 1403, and threaded shafts 1501. In one embodiment, rectangular plate assemblies 1404 may be welded to the ends of rigid support structures 1502 where manufactured. At the showroom where the display system is installed, the rigid support structures with the baseplate assemblies may be bolted to baseplate 1401 and 1504. Baseplate 1401 may include a straight edge 1504. This configuration allows two display assemblies to be placed in a back to back abutting relationship to form a circular or elliptical display system. It will also be appreciated that a display system may be configured with a quarter-circle baseplate. This will allow the one system to be positioned in the interior corner of a room, or two to be placed in an abutting position to form a semicircle, or three to be placed in an abutting position and placed in a ¾ circle relationship surrounding a wall intersection, or four may be placed in an abutting position to form a circular display. Threaded shafts 1501 are attached to baseplate 1401 and 1504 by nuts both below and above the baseplate. The use of steel angles for the rigid support structures provides a display that is sufficient to stably hold a fully loaded product display, while light enough to be both shipped and moved within a showroom. The orientation of the steel angles so their central portions face the curved perimeter of the baseplate further improves the stability of the system.

Figure 21:
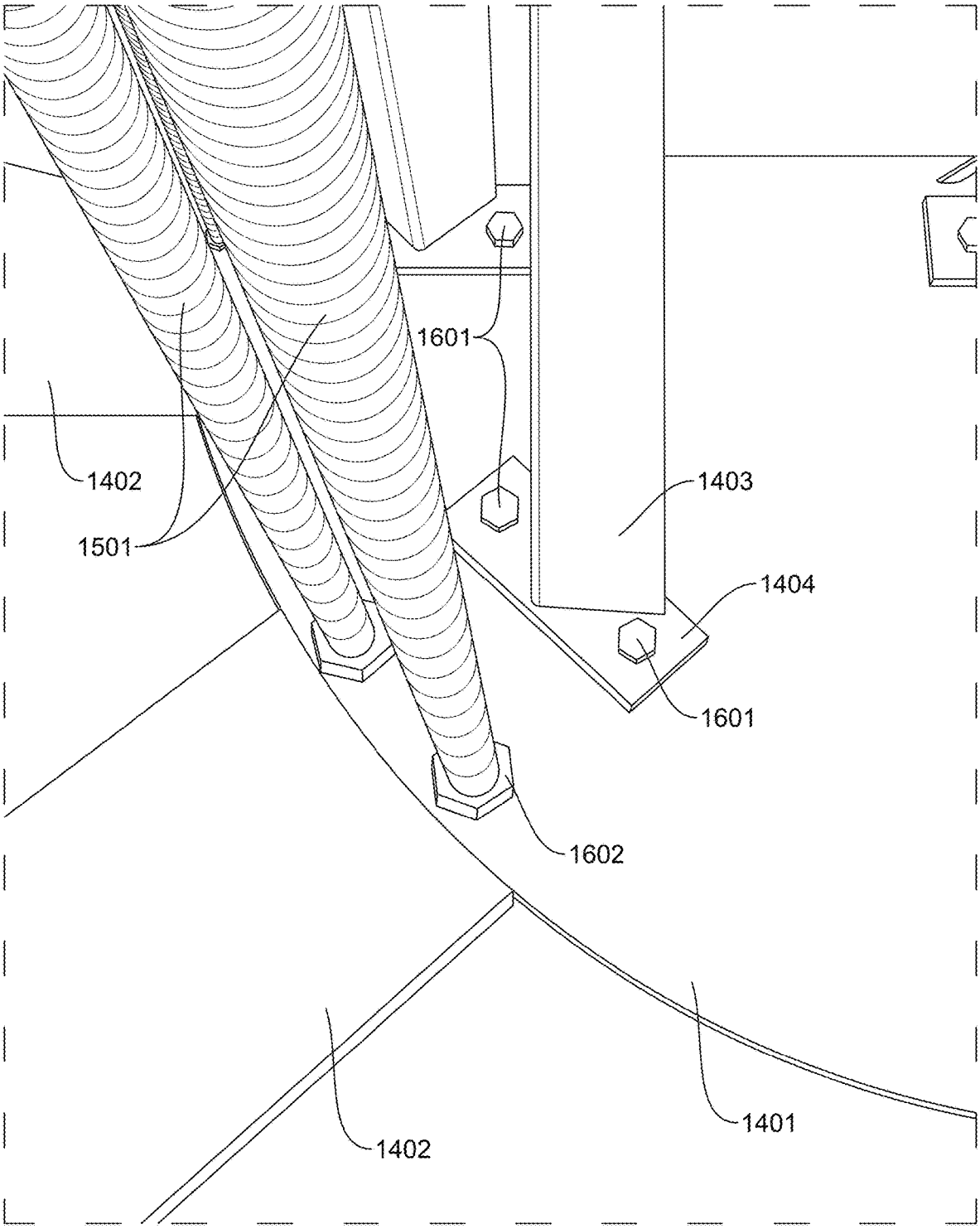
FIG. 21 is a view showing a floor baseplate, legs, rigid support structures, and threaded shafts.

FIG. 21 shows floor baseplate 1401 legs 1402, rigid support structures 1403, and threaded shafts 1501. It will be appreciated that the rigid support structures 1403 and threaded shafts 1501 may be positioned over the legs, which provides improved transfer of the load carried by these components. Plates 1404 may be welded to the rigid support structures 1403, and bolted to baseplate 1401 and 1402.

Figure 22:
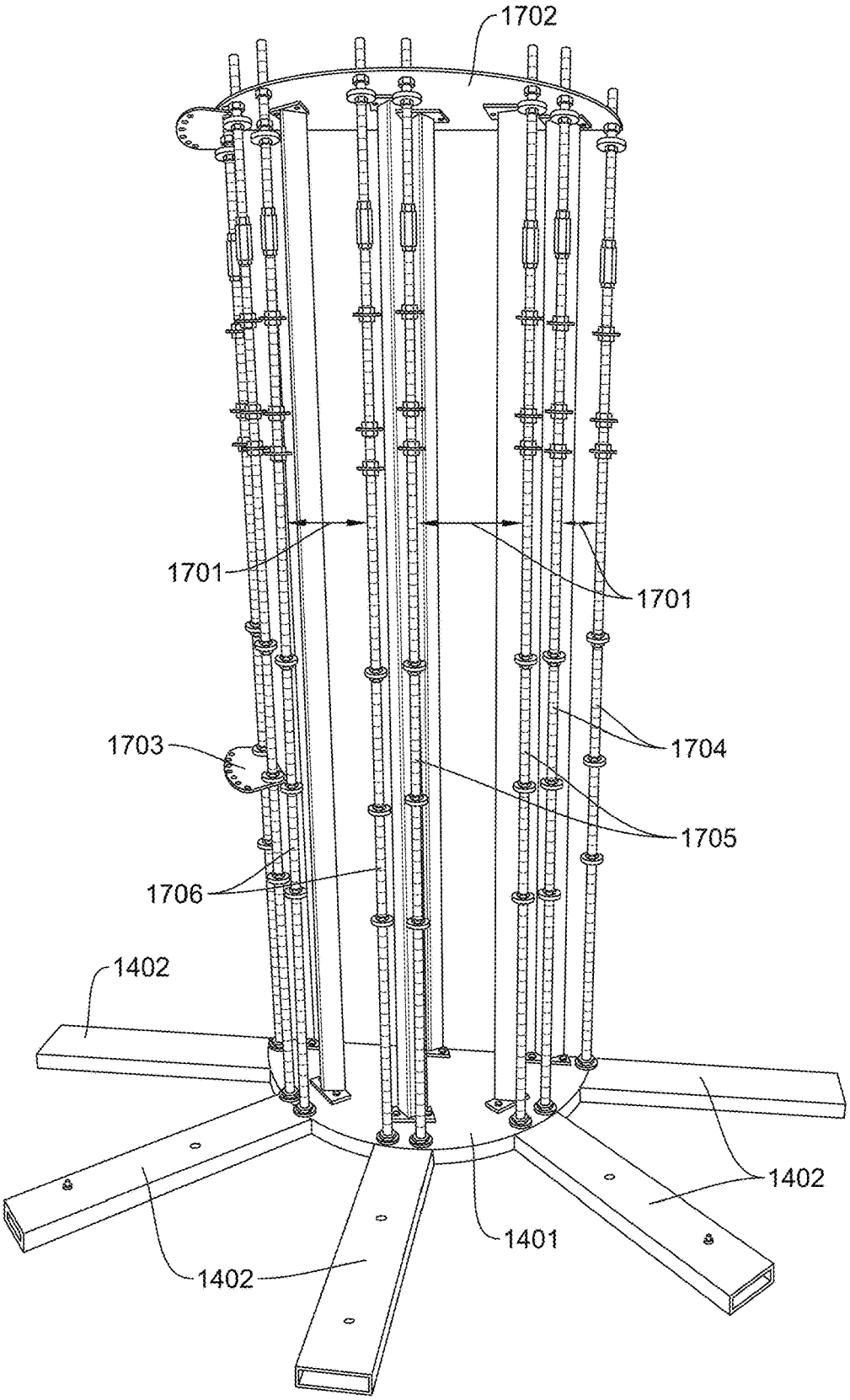
FIG. 22 is a view of a second exemplar of components of a display system including rigid support structures, and also showing the floor baseplate with legs with levelling mechanisms, an upper plate, and threaded shafts showing how they may be connected proximal to the legs and in which threaded shaft pairs are equally spaced.

FIG. 22 is a view of a display system including rigid support structures, and also showing the floor baseplate 1401 with legs 1402 with levelling mechanisms (represented by the threaded bolts in the distal part of legs. By rotating the bolts, a particular leg may be adjusted to compensate for irregularities in the height of the floor where the display system is installed. In this embodiment, each pair 1704, 1705 and 1706 of threaded shafts has one shaft located over one leg, and the other shaft located over another leg. This configuration helps distribute the load of the product display wings among the legs to stabilize the display. The distances 1701 between threaded shaft pairs 1704, 1705 and 1706 is the same. This allows a wing support bracket 1703 to be placed between any threaded shaft pair. This gives the merchant flexibility in deciding which products to display at which locations on the display system. The upper part of threaded shafts are attached to upper plate 1702.

Figure 23:
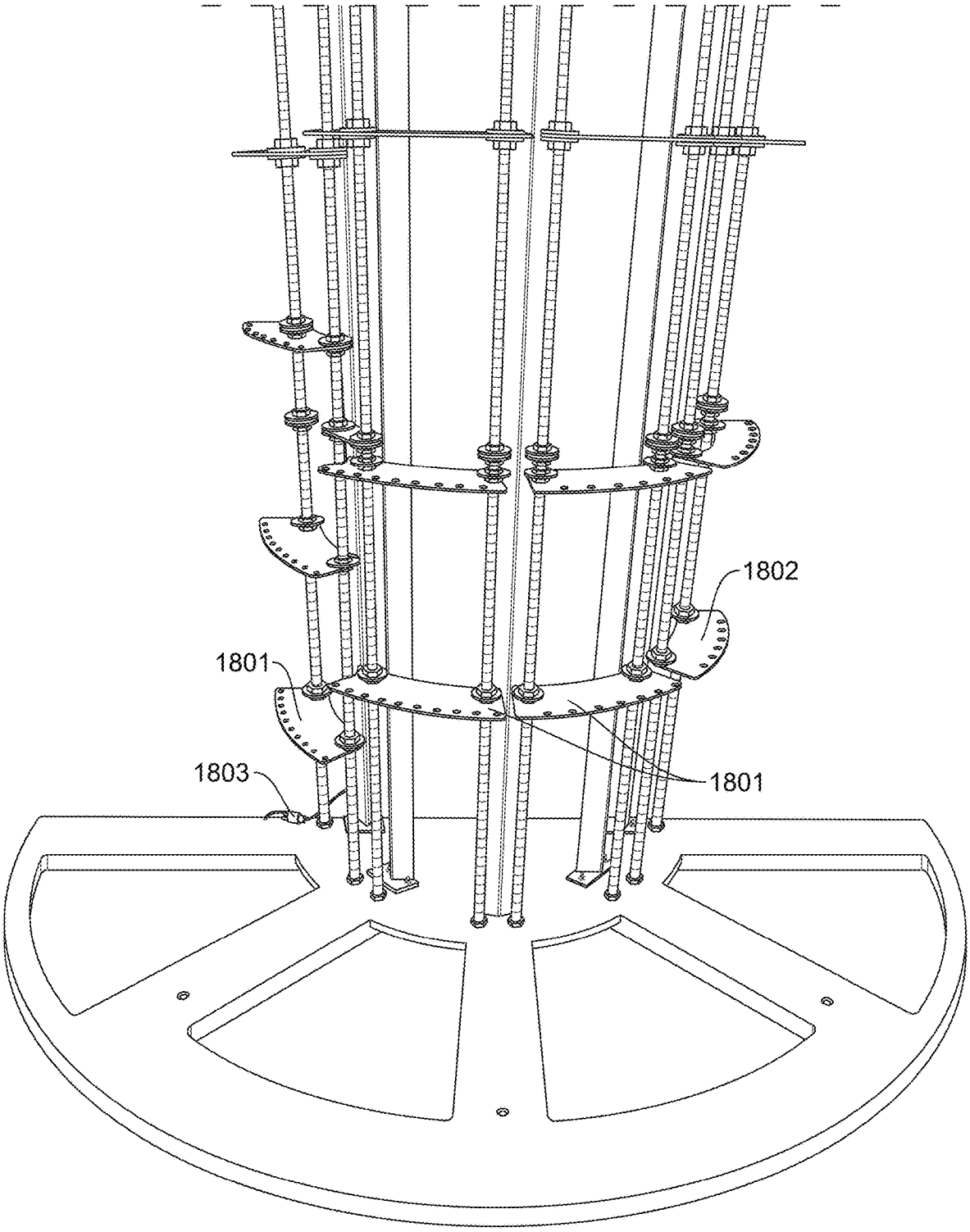
FIG. 23 shows how multiple with wing support brackets may be mounted on at selected heights on threaded shafts, to thereby accommodate display wights of differing heights.

FIG. 23 shows how different wing support brackets 1801, 1802 may be secured on threaded shafts at selected heights, to thereby accommodate display wings of differing heights. Normally, a first wing support bracket will be mounted on a pair of threaded shafts below the product display wing it holds, and a second wing support bracket is mounted on the same pair of threaded shafts.

Figure 24:
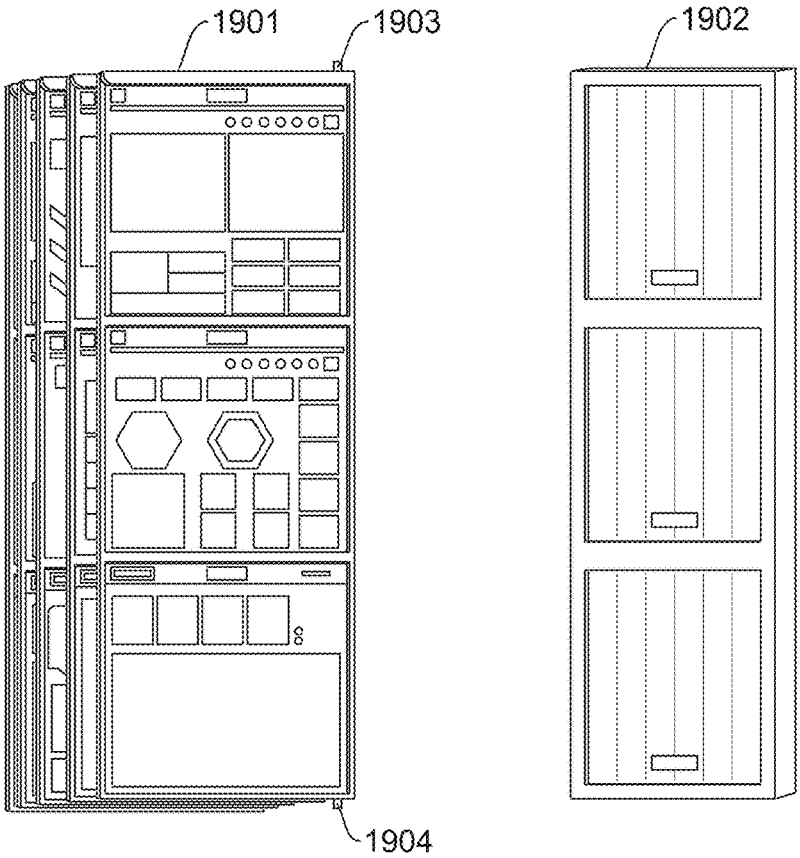
FIG. 24 shows two versions of display wings, one of which has pegs in one corners to fit into holes in wing support brackets.
Figure 25:
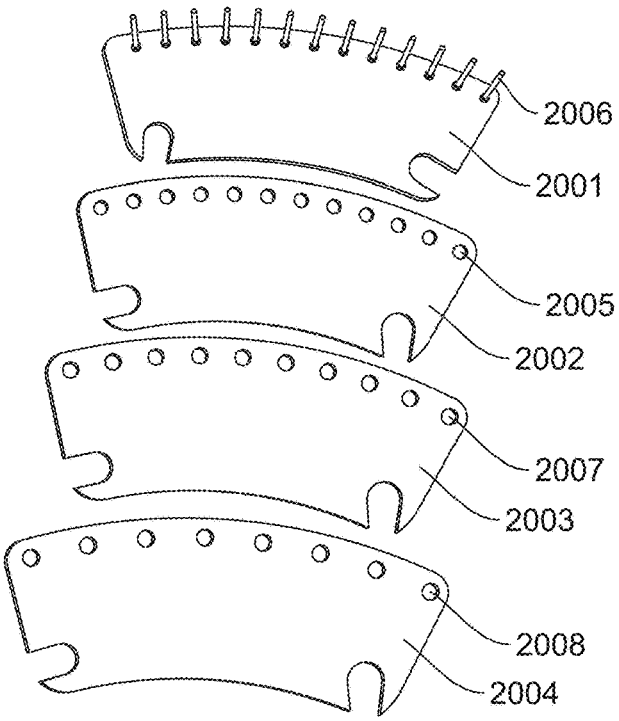
FIG. 25 shows versions of wing support brackets having pegs and holds for holding product display wings.

FIG. 24 shows two versions of product display wings. Product display wing 1901 us upper peg 1903 and lower peg 1904, and pivots about an axis intermediate those pegs. The pegs fit into holes of wing support brackets as shown in FIG. 25. Product display wing 1902 has an exterior frame with holes (not shown) in the upper and lower corner in about the same position as the pegs of wing 1901. To mount product display wing 1902, the wing may be lifted so the hole in the top corner surrounds a downwardly projecting peg from an upper wing support bracket, and then the wing is tilted until the hole in the bottom corner is over an upwardly projecting peg 2006 of a lower wing support bracket. The wing is then dropped so its weight is held by the lower wing support bracket.

Figure 26:
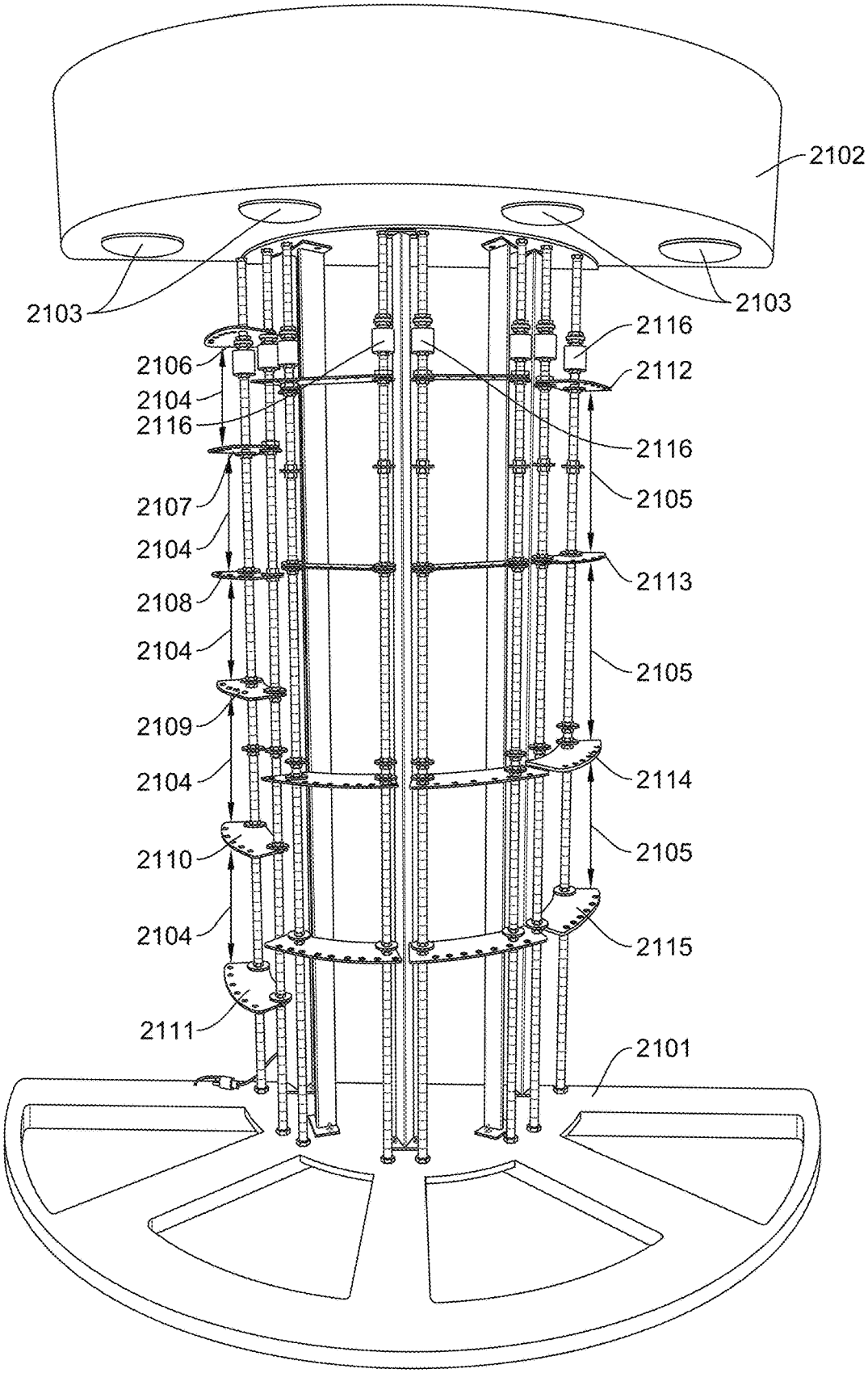
FIG. 26 shows a display system in which the upper plate holds lights that project downward toward product the area where product display wings may be positioned, and an arcuate display extending from the upper plate.

FIG. 25 shows versions of wing support brackets having pegs and holes for holding product display wings, 2001, 2002, 2003 and 2004. In one embodiment, a product display wing comprises an inner edge, and outer edge, a first side edge and a second side edge, a top surface and a bottom surface. The inner edge may be concave, and the outer edge may be convex. The upper surface may comprise a plurality of display wing connection means proximate the outer edge, each such connection means adapted to hold a product display wing such that the product display wing may pivot along a vertical axis extending perpendicularly from the connection means. The connection means may comprise pegs 2006, holes 2008, or any other structure that permits a product display to pivot. The connection means may include bushings, bearings or washers or other components to reduce friction. The inner edge may have a notch extending between the top and bottom surfaces and sized to receive a first vertical threaded shaft to hold the wing support bracket to a vertical threaded shaft. In 2001, the notch in the inner edge is on the left, and in 2002-2004, the notch is on the right. The first side edge may also have a notch extending between the top and bottom surfaces and sized to receive a vertical threaded shaft to hold the wing support bracket to a second vertical threaded shaft. In 2001, the notch of the first side edge is on the right, and in 2002-2004, the notch is on the left. In this embodiment, the notch of the side edge may be inserted around a threaded shaft, and the wing support bracket may be pivoted until the notch on the inner edge engages another threaded shaft. Nuts on the threaded shaft may be tightened above and below each notch to hold the wing support bracket at a selected height on the threaded shaft, as shown in FIG. 26. By use of these notches, a wing support bracket can be added, removed or relocated on the display system after it is assembled, i.e., after the threaded shafts have been secured to bottom and upper plates. This makes the system easier to use as compared to a wing support bracket that has only holes through which the threaded shafts must be inserted during assembly of the display system.

The number of connection means on a wing support bracket may vary to accommodate product display wings of different widths, as the wings are often supplied by a product manufacturer. For example, wing support bracket 2001 has 13 pegs, and may accommodate 13¼" wide product display wings. Wing support bracket 2002, 2003 and 2004 have 12, 10 and 8 holes, respectively, so they can accommodate product display wings of increasing thickness. Typically, two wing support brackets will be required for set of product display wings held, one at the top and one at the bottom. Thus, for a configuration where four sets of product display wings will vertically held by two threaded shafts, eight wing support brackets are typically required; one at the top and one at the bottom of each set of display wings. This would require sixteen nut-washer sets on each threaded shaft so there can be a nut-washer set both above and below each wing support bracket. In addition connectors 51 (FIG. 5) or 2116 of FIG. 26 may be used to form continuous threaded shafts of a desired height. For example, the use of connectors 51 or 2116 allow a standard length 6 foot threaded shaft to be used at the bottom and a 1 foot or 18 inch threaded shaft immediately above. The use of these standard length threaded shafts reduces manufacturing cost. In addition connector 2116 can be disconnected from the upper and lower threaded shafts which will allow removal or addition of nuts and washers to add wing support brackets without complete disassembly of the entire display.

FIG. 26 shows a display system in which the upper plate holds lights 2103 that project downward toward the area where product display wings may be positioned, and a removable arcuate display 2102 extending from the upper plate. Arcuate display may be a flexible material and printed with descriptions of the products displayed, names of manufacturers, information about sales, or any other information a merchant may desire.

FIG. 26 also shows wing support brackets being positioned at differing heights so they may hold product display wings of different heights. The left-most set of wing support brackets 2106, 2107, 2108, 2109, 2110, and 2111 may be spaced to hold product display wings of a first height 2104, while the right-most display support brackets 2112, 2113, 2114 and 2115 may be spaced further apart by distance 2105 to accommodate taller product display wings. Each wing support bracket is held in place by two sets of upper and lower washers and nuts. The number of nuts required for a threaded shaft may not be known when a display system is assembled. For maximum flexibility, it is desirable to thread enough nut-washer combinations onto each threaded shaft that would ever be needed. If taller product display wings are used which require fewer wing support brackets, the extra nut-washer combination can be remain unused. However, they will be available if the merchant decided to modify the display to use more vertically stacked display wings, without having to disassemble the display system.

Figure 27:
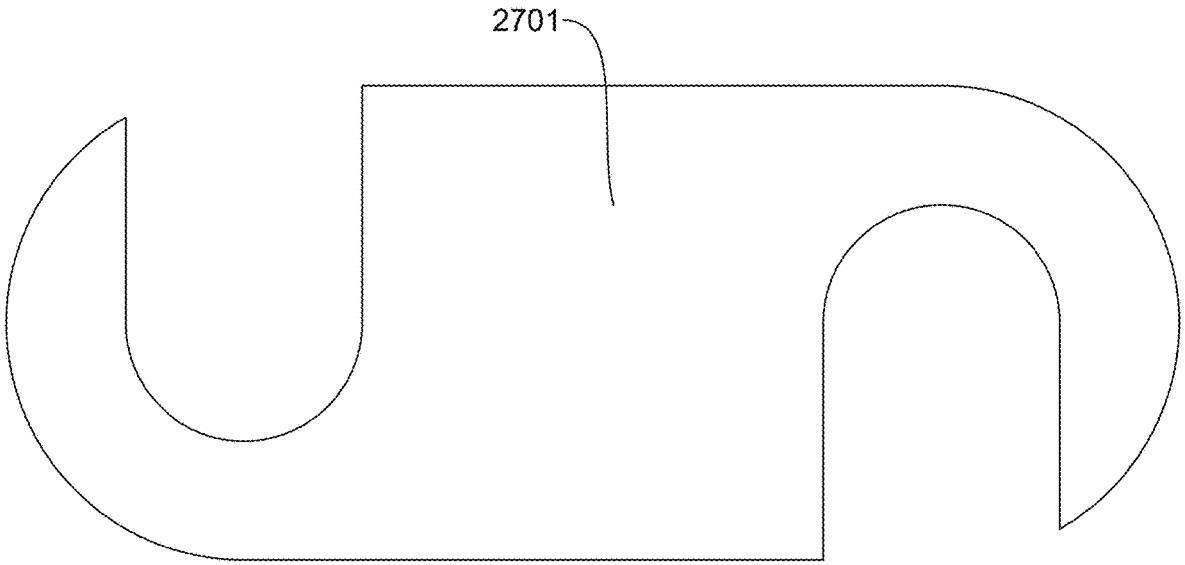
FIG. 27 shows an S connector suitable for securing adjacent threaded shafts to increase the structural integrity of the display system.

FIG. 27 shows an S connector 2701 suitable for securing adjacent threaded shafts to increase the structural integrity of the display system. The two notches in the S connector may be the same size as the notches in the product display wings shown in FIG. 25. It may be used between adjacent threaded shafts in lieu of, for example, the central support shown as 33 in FIG. 5. Because it is smaller, it facilitates a display that is lighter, easier to use and less expensive.

Figure 28:
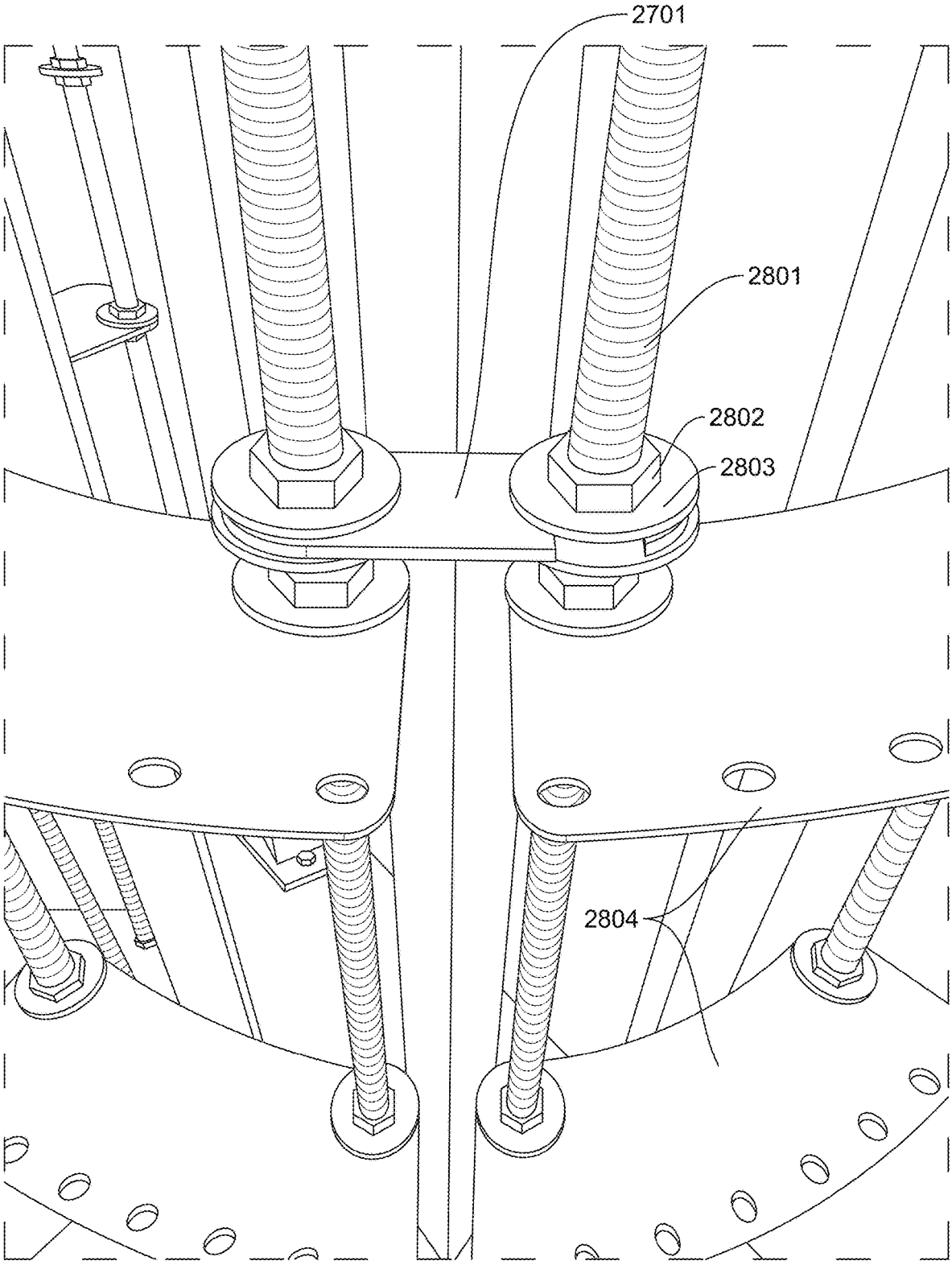
FIG. 28 shows an S connector mounted to adjacent threaded shafts.

FIG. 28 shows an S connector 2701 mounted to adjacent threaded shafts. Sets of nuts 2802 and washers, 2903 are tightened above and below S connector 2701. While display wing brackets 2804 provide horizontal stability for the threaded shaft pairs on which they are mounted, S connectors 2701 provide additional horizontal stability between sets of pairs of threaded shafts.

Figure 29:
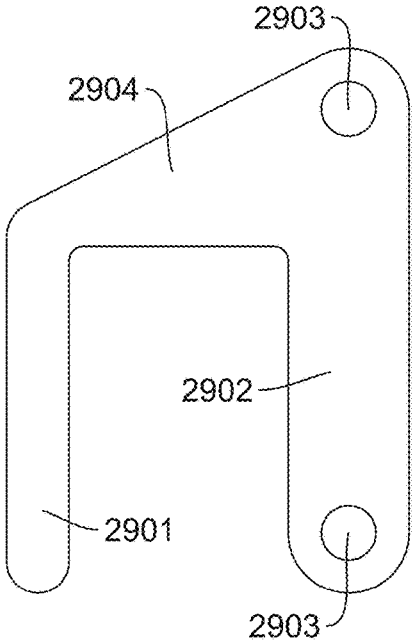
FIG. 29 shows a bracket which may be attached to product samples to create product display wings.
Figure 30:
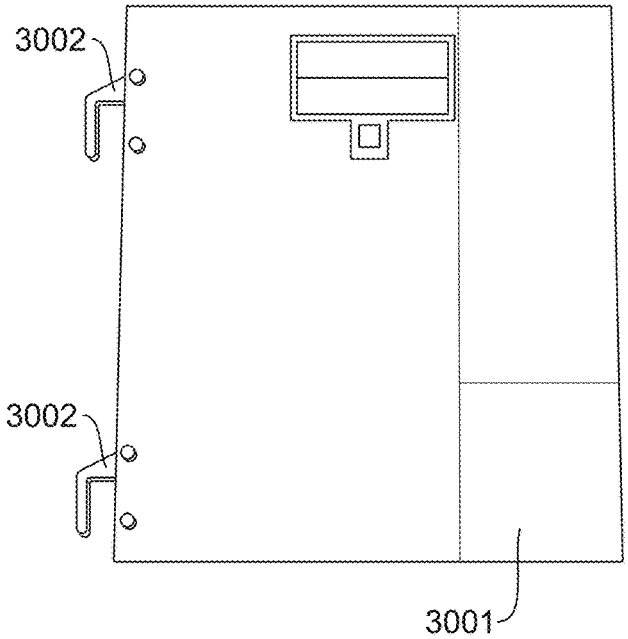
FIG. 30 shows a product display wing made by a product sample with two brackets of FIG. 29 attached thereto.

FIG. 29 shows a bracket which may be attached to product samples to create product display wings. Bracket may have an attachment member 2902 having holes 2903 which may be used to screw or rivet bracket to a product sample as shown in FIG. 30. Lateral extension 2904 extends from attachment member and peg 2902 extends form lateral extension 2904. Peg 2901 may be inserted into a hole 2005, 2007 or 2008 of a wing support bracket 2002-2004 as shown in FIG. 25.

FIG. 30 shows a product display wing made by a product sample with two brackets of FIG. 29 attached thereto. Product sample 3001 is typically supplied by a product manufacturer, and may comprise a sample of flooring, carpet, tile, shingles or other material to be displayed. If product sample 3001 is not a rigid material, it may be affixed to a backboard so it does not flex. Brackets 3002 may be attached to product sample 3001 to thereby form a product display wing. The distance between brackets 3002 may be selected to match the distance between wing support brackets, such as distance 2104 or 2105 as shown in FIG. 26. A product display wing with the brackets as shown allows the display wing to pivot around the peg 2901. Also, the display wing may be easily lifted to remove it from the display so a customer may view it more closely. In addition, if a retailer wishes to replace a product display wing, the bracket may be recycled by removing from one product display and mounting them on a different product display.

Figure 31:
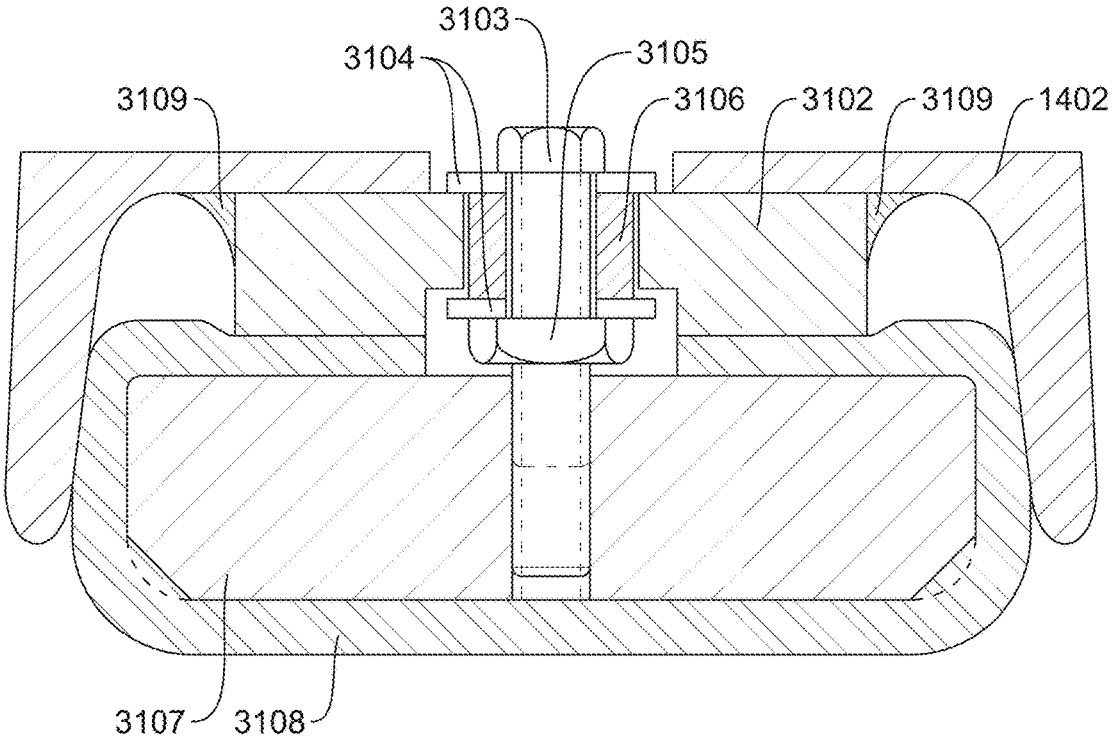
FIG. 31 is a cross section of a leg of the display system having a floor levelling mechanism.

FIG. 31 is a cross section of a system for leveling a display system on uneven flooring and also a feature to protect the display showroom floor when needing to move the display to another area. The system consists of a rectangular steel housing 3102, a steel spacer 3106 is inserted into the steel housing and is free to rotate with respect to the 3102 housing. Steel housing 3102 may be welded to the interior of channel at welds 3109. Bolt 3103 is inserted into the 3106 spacer with a 3104 washer, one each end of the 3106 insert as shown in FIG. 31. A nut 3105 is threaded onto the bolt 3103 and torqued to 38 foot lbs. By design the length of the spacer 3106 is greater than the length of the counter bore in housing 3102 to allow vertical movement of the washers 3014. The washers 3014 will move in a circular movement. The leveling block 3107 has a threaded hole in the center and is wrapped with a protective material such as commercial carpet tile 3108.

These components may be assembled into a 5" channel or leg 1402 by threading bolt 3103 into the leveling block 3107. Bolt 3103 is turned in clockwise direction to position the leveling block as shown in the installed position in FIG. 31. Upper washer 3104 provides a ground for the vertical movement and the sides of the 5" channel 1402 provides the circular ground for leveling block 3107. When leveling is needed bolt 3103 is turned in a counter-clockwise direction and lower washer 3104 provides the ground for the procedure.

Figure 32:
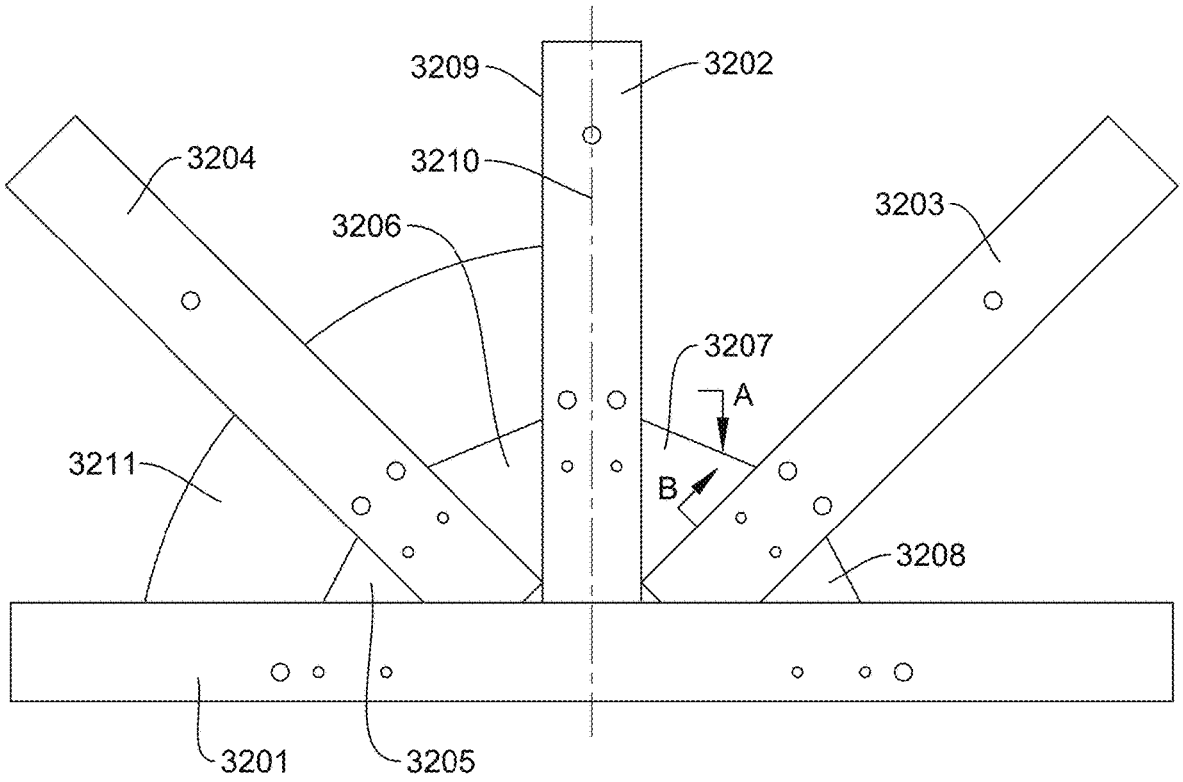
FIG. 32 is a bottom view of legs of a product display system.

FIG. 32 is a bottom view of legs of a product display system. For a half circle display system, back leg 3201 may be provided, with a central perpendicular let 3202 and 45 degree legs 3203 and 3204. The legs may be comprised of channel steel as shown as 1402 in FIG. 31. To improve structural integrity, steel gusset plates 3205, 3206, 3207 and 3208 may be welded to the legs where they abut. For a quarter circle display system the perpendicular leg may be half width, i.e., only from side 3209 to midline 3210. This will allow two quarter circle display systems to be placed so they abut each other to form a half circle display. A quarter circle display may also abut a half circle display to create a ¾ circle display, or four may be combined to form a full circular display. In any of these configurations, a baseplate cover 3211 may be added and bolted to the legs to provide additional structural integrity or a more pleasing appearance when viewed from the top.

While the invention has been illustrated and described in detail in the foregoing drawings and description, the same is to be considered as illustrative and not restrictive in character, it being understood that only illustrative embodiments thereof have been shown and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A display system for holding pivotable product display wings comprising:

a floor baseplate comprising a center area, an upper plate having a center area, a plurality of rigid support structures, each rigid support structure having an upper end and a lower end, each lower end being rigidly connected to the floor baseplate and each upper end connected to the upper plate, such that the center area of the floor baseplate is above the center area of the upper plate, and one of the rigid support structures connects to the center area of the floor baseplate and to the center area of the upper plate, there is a distance between the rigid support structure in the center area and the other rigid support structures, a plurality of threaded shafts, each threaded shaft having an upper end and a lower end, each lower end being rigidly connected to the floor baseplate and each upper end connected to the upper plate, such that there is a distance between the rigid support structure in the center area and each of the plurality of threaded shafts, said distance being greater than the distance between the distance between the rigid support structure in the center area and the other rigid support structures, at least one wing support bracket attached to at least one of the plurality of threaded shafts at a selectable vertical position on the threaded shaft(s), the wing support bracket operable to hold a pivotable display wing.

2. The display system of claim 1 wherein at least one of the plurality of rigid support structures comprises a steel angle.

3. The display system of claim 1 wherein the floor baseplate further comprises a plurality of legs extending from the center area of the baseplate.

4. The display system of claim 3 wherein the lower end of at least one of the plurality of rigid support structures is rigidly connected to one of the plurality of legs.

5. The display system of claim 3 wherein the lower end at least one of the plurality of threaded shafts is rigidly connected to one of the plurality of legs.

6. The display system of claim 3 wherein at least one of the legs comprises a levelling mechanism operable to adjust the distance between the leg and a floor.

7. The display system of claim 1 wherein the floor baseplate and the upper plate are comprised of steel.

8. The display system of claim 1 wherein the plurality of threaded shafts comprise multiple pairs of threaded shafts wherein the distance between each such pair of threaded shafts is the same.

9. The display system of claim 8, wherein the floor baseplate further comprises a plurality of legs extending from the center area of the baseplate, the plurality of threaded shafts comprise multiple pairs of threaded shafts, whereby for each pair of threaded shafts, the bottom ends of each threaded shaft of the pair is secured to a different leg to thereby distribute the weight of product display wings supported by each pair of threaded shaft among the different legs.

10. The display system of claim 1, further comprising multiple product display support brackets, and wherein each product display support bracket is mounted on at least two different vertically extending threaded shafts.

11. The display system of claim 9, wherein at least some of the multiple product display support brackets are mounted on the vertically extending threaded shafts at different vertical distances from the support baseplate.

12. The display system of claim 1, wherein the vertically extending threaded shafts are in an arcuate shape.

13. The display system of claim 1, wherein the floor baseplate and the upper plate have at least one straight edge.

14. A multi-unit display system for holding pivotable product display wings comprising a first and a second display system of claim 12, whereby the straight edge of the floor baseplate of the first display system abuts the straight edge of the floor baseplate of the second display system, and the straight edge of the upper plate of the first display system abuts the straight edge of the upper plate of the second display system.

15. The display system of claim 1 further comprising a lower threaded nut threaded on the at least one of the plurality of threaded shafts supporting the at least one wing support bracket at the selectable vertical position.

16. The display system of claim 14 further comprising an upper threaded nut on the same threaded shaft on which the lower threaded nut is threaded, the lower and upper threaded nuts being tightened to compress the at least one wing support bracket between the upper threaded nut and the lower threaded nut to hold the at least one wing support bracket in place.

17. A display system for holding product display wings comprising:

a floor baseplate comprising a center area, an upper plate having a center area, a plurality of threaded shafts, each threaded shaft having an upper end and a lower end, each lower end being rigidly connected to the floor baseplate and each upper end connected to the upper plate, such that the threaded shafts form an arc around the center areas of the floor baseplate and the upper plate, at least one wing support bracket positionable on at least one of the plurality of threaded shafts at a selectable vertical position on the threaded shaft(s), and an arcuate display extending from the upper plate.

18. The display system for holding product display wings of claim 16 wherein the arcuate display is removable from the upper plate.

19. A display system for holding product display wings comprising:

a floor baseplate comprising a center area, an upper plate having a center area, a plurality of threaded shafts, each threaded shaft having an upper end and a lower end, each lower end being rigidly connected to the floor baseplate and each upper end connected to the upper plate, such that the threaded shafts form an arc around the center areas of the floor baseplate and the upper plate, at least one wing support bracket positionable on at least one of the plurality of threaded shafts at a selectable vertical position on the threaded shaft(s), and the upper plate further comprising a plurality of downwardly projecting lights to project light toward a display wing mounted on the at least one wing support bracket.

20. A vertically positionable wing support bracket for holding a plurality of product display wings comprising:

a support structure comprising an inner edge, and outer edge, a first side edge and a second side edge, a top surface and a bottom surface, the upper surface comprising a plurality of display wing connection means proximate the outer edge, each such connection means adapted to hold a product display wing such that the product display wing may pivot along a vertical axis extending perpendicularly from the connection means, the inner edge having a notch extending between the top and bottom surfaces and sized to receive a first vertical threaded shaft to hold the wing support bracket to the vertical threaded shaft, the first side edge having a notch extending between the top and bottom surfaces and sized to receive a vertical threaded shaft to hold the wing support bracket to a second vertical threaded shaft, such that multiple product display wings may be held by the wing support bracket and such that each product display wing may independently pivot along a vertical axis with respect to the other product display wings held by the wing support bracket.

21. The vertically positionable wing support bracket of claim 18 wherein the display wing connection means comprise holes in the top surface.

22. The vertically positionable wing support bracket of claim 18 wherein the display wing connection means comprise pegs extending from the top surface or the bottom surface.

23. A display system for holding product display wings comprising:

a floor baseplate, an upper plate, a plurality of sets of threaded shafts, each threaded shaft having an upper end and a lower end, each lower end being rigidly connected to the floor baseplate and each upper end connected to the upper plate, at least one wing support brackets securely positioned on each set of threaded shafts at a selectable vertical position on the threaded shaft(s), each wing support bracket comprising two notches each sized to receive a threaded shaft, an S connector connecting one of the threaded shafts of one set of threaded shaft to an adjacent threaded shaft of a different set of threaded shafts, the S connector comprising two notches each sized to receive a threaded shaft.

24. A display system for holding product display wings comprising:

a floor baseplate comprising a center area, and a plurality of legs extending from the center area, an upper plate having a center area, a plurality of steel angles, each steel angle having an upper end and a lower end, each lower end being rigidly connected to the floor baseplate and each upper end connected to the upper plate, such that the center area of the floor baseplate is above the center area of the upper plate, and one of the steel angles connects to the center area of the floor baseplate and to the center area of the upper plate, and at least one of the other steel angles connects to a leg of the floor baseplate, there is a distance between the steel angle in the center area and the other steel angles, a plurality of threaded shafts, each threaded shaft having an upper end and a lower end, each lower end being rigidly connected one of the legs of the floor baseplate and each upper end connected to the upper plate, such that there is a distance between the steel angle in the center area and each of the plurality of threaded shafts, said distance being greater than the distance between the distance between the steel angel in the center area and the other steel angles, a plurality of wing support brackets, each being vertically attached to at least one of the plurality of threaded shafts, each such wing support bracket supporting a pivotable display wing.

* * * * *